US012279736B2

(12) United States Patent
Kim et al.

(10) Patent No.: US 12,279,736 B2
(45) Date of Patent: Apr. 22, 2025

(54) DISHWASHER

(71) Applicant: LG Electronics Inc., Seoul (KR)

(72) Inventors: Seungyoun Kim, Seoul (KR); Jeongkon Kim, Seoul (KR); Hyung Man Park, Seoul (KR); In Woo Baek, Seoul (KR); Youngsoo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 788 days.

(21) Appl. No.: 17/508,601

(22) Filed: Oct. 22, 2021

(65) Prior Publication Data

US 2022/0125276 A1 Apr. 28, 2022

(30) Foreign Application Priority Data

Oct. 22, 2020 (KR) ..... 10-2020-0137873

(51) Int. Cl.
*A47L 15/48* (2006.01)

(52) U.S. Cl.
CPC ..... *A47L 15/483* (2013.01)

(58) Field of Classification Search
CPC ..... A47L 15/483; A47L 15/486; A47L 15/488
See application file for complete search history.

(56) References Cited

U.S. PATENT DOCUMENTS 10,039,434 B2 * 8/2018 Park ..... A47L 15/483
2006/0096621 A1 * 5/2006 Lee ..... A47L 15/483
134/95.2
2009/0038661 A1 * 2/2009 Hildenbrand ..... A47L 15/486
134/107
2010/0192977 A1 * 8/2010 Jadhav ..... A47L 15/4257
134/57 D
2010/0300499 A1 * 12/2010 Han ..... A47L 15/483
134/172
2014/0223761 A1 * 8/2014 Lee ..... A47L 15/488
34/218

(Continued)

FOREIGN PATENT DOCUMENTS

CN 108784606 A * 11/2018 ..... A47L 15/00
CN 111387903 7/2020

(Continued)

OTHER PUBLICATIONS

Extended European Search Report in European Appln. No. 21204259.2, dated Feb. 23, 2022, 9 pages.

*Primary Examiner* — Omair Chaudhri
(74) *Attorney, Agent, or Firm* — Fish & Richardson P.C.

(57) ABSTRACT

A dishwasher includes a tub, a door, and a drying device disposed outside the tub. The drying device includes a condensing duct that faces an outer surface of the tub, that is in fluid communication with an inlet port defined at the tub, and that extends in a vertical direction and a first direction intersecting the vertical direction, and a fan configured to cause a flow of air in the condensing duct. The condensing duct includes an upstream portion in fluid communication with the inlet port, a downstream portion that is in fluid communication with the upstream portion and includes a bent portion disposed below the upstream portion, and a rib that is disposed inside the bent portion and extends across the bent portion, where the rib protrudes in a second direction that intersects the vertical direction and the first direction.

20 Claims, 19 Drawing Sheets

(56) References Cited

U.S. PATENT DOCUMENTS

| | | | | |
|---|---|---|---|---|
| 2015/0342441 | A1* | 12/2015 | Hahm | A47L 15/481 34/79 |
| 2016/0022116 | A1* | 1/2016 | Delellis | A47L 15/486 34/218 |
| 2017/0290489 | A1* | 10/2017 | Noriega | A47L 15/4293 |
| 2018/0249884 | A1* | 9/2018 | Hofmann | A47L 15/488 |
| 2019/0038109 | A1 | 2/2019 | Delellis et al. | |
| 2019/0246871 | A1* | 8/2019 | Yoon | A47L 15/486 |
| 2019/0350432 | A1* | 11/2019 | Kopera | A47L 15/486 |

FOREIGN PATENT DOCUMENTS

| | | |
|---|---|---|
| EP | 3102084 | 12/2016 |
| EP | 3524129 | 8/2019 |
| WO | WO2015119672 | 8/2015 |

* cited by examiner

DISHWASHER

CROSS-REFERENCE TO RELATED APPLICATION

This application claims priority to and the benefit of Korean Patent Application No. 10-2020-0137873, filed on Oct. 22, 2020, the disclosure of which is incorporated herein by reference in its entirety.

TECHNICAL FIELD

The present disclosure relates to a dishwasher, and more particularly, to a dishwasher that can improve drying performance, help to prevent a drying device from being broken down by water, and reduce or prevent proliferation of bacteria or mold in a condensing duct.

BACKGROUND

A dishwasher is a household electrical appliance that may spray a washing liquid to washing targets such as dishes or cookware to remove foreign substances remaining on the washing targets.

In some cases, the dishwasher may include a tub configured to provide a washing space, a rack disposed in the tub and configured to accommodate dishes and the like, a spray arm configured to spray a washing liquid to the rack, a sump configured to store the washing liquid, and a washing pump configured to supply the spray arm with the washing liquid stored in the sump.

In some examples, the dishwasher may include a drying module. For example, the drying module may remove moisture remaining on the dish (drying target) by supplying heated air into the tub (a washing chamber or a drying chamber).

The drying modules may be classified into an open-circulation drying module and a closed-circulation drying module. The open-circulation drying module may discharge moist air in the tub to the outside of the tub, heat outside air, and supply the heated air into the tub. The closed-circulation drying module may discharge moist air in the tub to the outside of the tub, remove moisture from the discharged air, and then supply the tub with the air from which the moisture is removed.

In some examples, the drying module may include a duct, a fan configured to allow air to flow in the duct, and a cooling module (e.g., a cold air supplying module) configured to adjoin the duct.

In some examples, a water drain port may be formed in a lower surface of the duct, and the water, which is introduced from the tub or condensed in the duct, may be discharged to the outside through the water drain port.

In some cases, a dishwasher may include a tub, a tub air outlet, an airflow conduit for connecting the tub air outlet to ambient air, an air blower assembly for allowing the air to flow from the tub to the airflow conduit through the tub air outlet, and a first reservoir connected to the airflow conduit and having a liquid outlet.

For instance, the airflow conduit may have a dogleg part with a partially inverted "U" shape. In some cases, a reservoir may be positioned at an upstream side of the dogleg part.

In some cases, where the water flows along a lateral surface of the dogleg part, the water may not be collected in the reservoir and discharged to the liquid outlet provided in the reservoir. In some cases, the drying performance may deteriorate, the drying device may be broken down by the water introduced into the duct through the dogleg part, and bacteria or mold may be proliferated in the duct.

SUMMARY

The present disclosure describes a dishwasher that can improve drying performance, that can reduce or prevent proliferation of bacteria or mold in a condensing duct, and that can help to prevent a drying device from being broken down by water.

The present disclosure also describes a dishwasher with an improved drying efficiency and energy efficiency.

According to one aspect of the subject matter described in this application, a dishwasher includes a tub having a washing space defined therein, a door disposed at a front side of the tub and configured to open and close at least a portion of the washing space, and a drying device configured to supply air to the washing space. The drying device includes a condensing duct that is disposed outside the tub and faces an outer surface of the tub, where the condensing duct being in fluid communication with an inlet port defined at the tub and extending in a vertical direction and a first direction that intersects the vertical direction. The drying device further includes a fan configured to cause a flow of air in the condensing duct. The condensing duct includes an upstream portion that is in fluid communication with the inlet port, a downstream portion that is in fluid communication with the upstream portion and includes a bent portion disposed below the upstream portion, where the downstream portion extends from the upstream portion downward to the bent portion and then extends upward from the bent portion, and a rib that is disposed inside the bent portion and extends across the bent portion, where the rib protrudes in a second direction that intersects the vertical direction and the first direction.

Implementations according to this aspect can include one or more of the following features. For example, the condensing duct can include a water drain port that is disposed at a lower end of the bent portion. In some implementations, the dishwasher can include a heat exchange portion that is connected to the upstream portion and extends downward from the upstream portion to the downstream portion, where the downstream portion is in communication with a downstream end of the heat exchange portion. In some examples, the condensing duct can include a water drain port that is disposed at a lower end of the bent portion, and the heat exchange portion can have a first surface and a second surface that face each other in the first direction. The bent portion can extend toward a first side of the first direction, and the water drain port and the lower end of the bent portion are disposed at a position closer to the first surface of the heat exchange portion than the second surface of the heat exchange portion in the first direction.

In some implementations, the downstream portion can have lateral surfaces that face each other and define the bent portion therebetween, where the rib protrudes inward from the lateral surfaces of the bent portion in the second direction. In some examples, the rib can traverse the bent portion in an up-down direction. In some examples, the rib can be connected to at least one of a lower surface of the bent portion or an upper surface of the bent portion. In some examples, an upper end of the rib can extend in the second direction and be connected to the upper surface of the bent portion.

In some implementations, the condensing duct can include a water drain port disposed at a lower end of the bent portion, where a lower end of the rib is positioned adjacent to the water drain port. In some examples, the bent portion can extend toward a first side of the first direction, and the rib can have a lower end and an upper end, where the upper end is disposed above the lower end and offset from the lower end toward the first side of the first direction. In some examples, the rib can include a height section in which a gradient of the rib increases as the rib extends upward.

In some implementations, the bent portion can include a descending duct portion having an upstream end that is in fluid communication with the upstream portion, where the descending duct portion extends downward in a descending inclined direction with respect to the vertical direction and toward a first side of the first direction. The bent portion can further include an ascending duct portion that is in fluid communication with a downstream side of the descending duct portion, where the ascending duct portion extends upward in an ascending inclined direction with respect to the vertical direction and toward the first side of the first direction. An upper end of the rib can be positioned in the ascending duct portion.

In some implementations, the rib can be one of a plurality of ribs that extend in parallel to one another and that are disposed inside the bent portion. In some examples, the condensing duct can include a water drain port that is disposed at a lower end of the bent portion, where at least one of the plurality of ribs extends to a position adjacent to the water drain port. For example, the plurality of ribs can include a first portion disposed at a first side with respect to the water drain port in the first direction, and a second portion disposed at a second side with respect to the water drain port, where the second side is opposite to the first side with respect to the water drain port.

In some examples, a curve length of the first portion of the plurality of ribs can be less than a curve length of the second portion of the plurality of ribs. In some examples, the first portion of the plurality of ribs can be connected to the lower end of the bent portion, and the second portion of the plurality of ribs can be connected to an upper end of the bent portion. In some implementations, a distance in the first direction between the lower end of the bent portion and the inlet port can be greater than a distance in the first direction between an upper end of the bent portion and the inlet port.

In some implementations, a downstream end of the upstream portion and an upstream end of the downstream portion can be disposed at one side of the inlet port in the first direction and spaced apart from each other in the vertical direction. In some implementations, the heat exchange guide can be disposed between the downstream end of the upstream portion and the upstream end of the downstream portion, where the heat exchange guide extends in the first direction.

In some implementations, the condensing duct can include the upstream portion communicating with the inlet port, and the downstream portion communicating with the upstream portion and including the bent portion bent to descend and then ascend. Therefore, the water introduced through the inlet port or the water condensed in the upstream portion or the heat exchange portion can be easily collected at a particular point on a lower surface of the bent portion and then discharged to the outside, which makes it possible to improve the drying performance. In some examples, since the bent portion is bent to descend and then ascend, the introduced water or the condensed water hardly passes through the bent portion due to the weight of the water. Therefore, the water cannot be introduced into the downstream side of the condensing duct by passing over the bent portion. Therefore, it can be possible to improve the drying performance of the drying device, prevent the drying device from being broken down by the water, and inhibit proliferation of bacteria or mold in the condensing duct.

In some implementations, the water drain port can be formed at the lower end of the bent portion. Therefore, the water introduced through the inlet port or the water condensed in the upstream portion or the heat exchange portion can be collected on the lower surface of the bent portion and then quickly and easily discharged through the water drain port formed at the lower end of the lower surface, which makes it possible to improve the drying performance.

In some implementations, the dishwasher can further include a heat exchange portion connected to the upstream portion and extends downward. The downstream portion can communicate with a downstream end of the heat exchange portion. The water condensed in the heat exchange portion can fall or flow downward by gravity, such that the condensate water can be easily collected and quickly discharged to the outside. Therefore, the drying efficiency can be improved.

In some implementations, a rib can be formed in the bent portion, protrude in the second direction, and traverse the bent portion. Therefore, the water can interfere with the rib, which can help to prevent the water from passing through the bent portion and being introduced into the downstream side of the condensing duct. Therefore, it can be possible to improve the drying performance of the drying device, prevent the drying device from being broken down by the water, and prevent proliferation of bacteria or mold in the condensing duct.

In some implementations, the bent portion can extend toward one side in the first direction. In this case, the water drain port and a lower end of the bent portion can be located closer to one end of two opposite ends in the first direction of the heat exchange portion. Therefore, an inclination of a lower surface of a descending duct portion can be gentle, such that the flow direction of the air can be slowly changed. Therefore, the flow resistance can be reduced, which makes it possible to improve the drying efficiency and energy efficiency.

In some implementations, the rib can protrude inward from two opposite lateral surfaces of the bent portion disposed in the second direction. Therefore, since the water is effectively interfered by the rib formed on the two opposite surfaces of the bent portion, it can be possible to effectively prevent the water from passing through the bent portion and being introduced into the downstream side of the condensing duct.

In some implementations, the rib can traverse the bent portion up and down. Therefore, since the extension direction of the rib intersects the flow direction of the air in the bent portion, the water is interfered by the rib, such that the water can be effectively prevented from passing through the bent portion. In particular, since the extension direction of the rib can be approximately perpendicular to the flow direction of the air in the bent portion, the water can be effectively interfered by the rib. In some examples, since the water, which interferes with the rib, flows downward along the rib by the weight of the water, the water can be easily collected on the lower surface of the bent portion and then discharged to the outside.

In some implementations, the rib can adjoin at least one of the lower surface and an upper surface of the bent portion. Therefore, it can be possible to prevent the water from passing through the bent portion, which flows along the lateral surfaces of the bent portion disposed in the second direction in the vicinity of the lower surface or the upper surface of the bent portion or which flows along the lower surface or the upper surface of the bent portion in the vicinity of the lateral surfaces of the bent portion disposed in the second direction.

In some implementations, the upper end of the rib can protrude in the second direction while adjoining the upper surface of the bent portion. Therefore, it can be possible to effectively prevent the water from flowing along the upper surface of the bent portion and passing through the bent portion.

In some implementations, the lower end of the rib can be positioned in the vicinity of the water drain port. Therefore, the water, which is interfered by the rib, flows to the vicinity of the water drain port along the rib by the weight of the water, such that the water can be quickly and easily collected and then discharged to the outside.

In some implementations, the bent portion can extend toward one side in the first direction. In this case, upper end of the rib can be positioned at one side of the lower end of the rib in the first direction. Therefore, the rib can be positioned such that the upper end of the rib is closer to the downstream side of the bent portion than is the lower end. Therefore, for example, even though the lower end of the rib is positioned in the vicinity of the water drain port without being positioned at the downstream side of the bent portion, the upper end of the rib can be positioned at the downstream side of the bent portion. Therefore, the condensate water, which is produced at the downstream side of the bent portion, is also interfered by the rib and cannot pass through the bent portion. Therefore, the drying performance can be improved.

In some implementations, the rib can include a height section at which a gradient of the rib increases as the height increases. Therefore, since the gradient of the rib is large at the upper portion of the height section, the water can easily flow downward along the rib by the weights of the water even though a small amount of water is interfered by the rib. In contrast, since the water is collected at the lower portion of the height section and the amount of water increases, the water can easily flow downward along the rib by the weight of the water even though the gradient of the rib is small at the lower portion of the height section. Therefore, since the water can be quickly and easily collected and then discharged to the outside, the drying performance can be improved. In some examples, the height section enables the upper end of the rib to be positioned at one side of the lower end of the rib in the first direction, which makes it possible to improve the drying performance. In some examples, at the height section, the gradient of the rib can be approximately perpendicular to the flow direction of the air in the bent portion, such that the water can be effectively interfered by the rib.

In some implementations, the bent portion can include: the descending duct portion communicating with the upstream portion and extending downward to be inclined toward one side in the first direction; and the ascending duct portion having the upstream end communicating with the downstream side of the descending duct portion and extending upward to be inclined toward one side in the first direction. In this case, the upper end of the rib can be positioned in the ascending duct portion. Therefore, at least a portion of the rib is positioned in the ascending duct portion in which the water is easily separated from the air by the weight of the water, such that the water is effectively interfered by the rib, thereby preventing the water from passing through the bent portion. In some examples, the upper end of the rib can be positioned at one side of the lower end of the rib in the first direction when the upper end of the rib is positioned in the ascending duct portion. Therefore, the drying performance can be improved.

In some implementations, the plurality of ribs can be formed in parallel in the bent portion. Therefore, the water is interfered by the plurality of ribs, which makes it possible to prevent the water from passing through the bent portion and being introduced into the downstream side of the condensing duct. Therefore, it can be possible to improve the drying performance of the drying device, prevent the drying device from being broken down by the water, and prevent proliferation of bacteria or mold in the condensing duct.

In some implementations, at least one rib can extend to the vicinity of the water drain port. Therefore, the water, which is interfered by the rib, can easily flow to the vicinity of the water drain port along the rib by the weight of the water, such that the water can be quickly and easily collected and then discharged to the outside. Therefore, the drying performance can be improved.

The specific effects of the present disclosure, together with the above-mentioned effects, will be described along with the description of specific items for carrying out the present disclosure.

DETAILED DESCRIPTION

Figure 1:
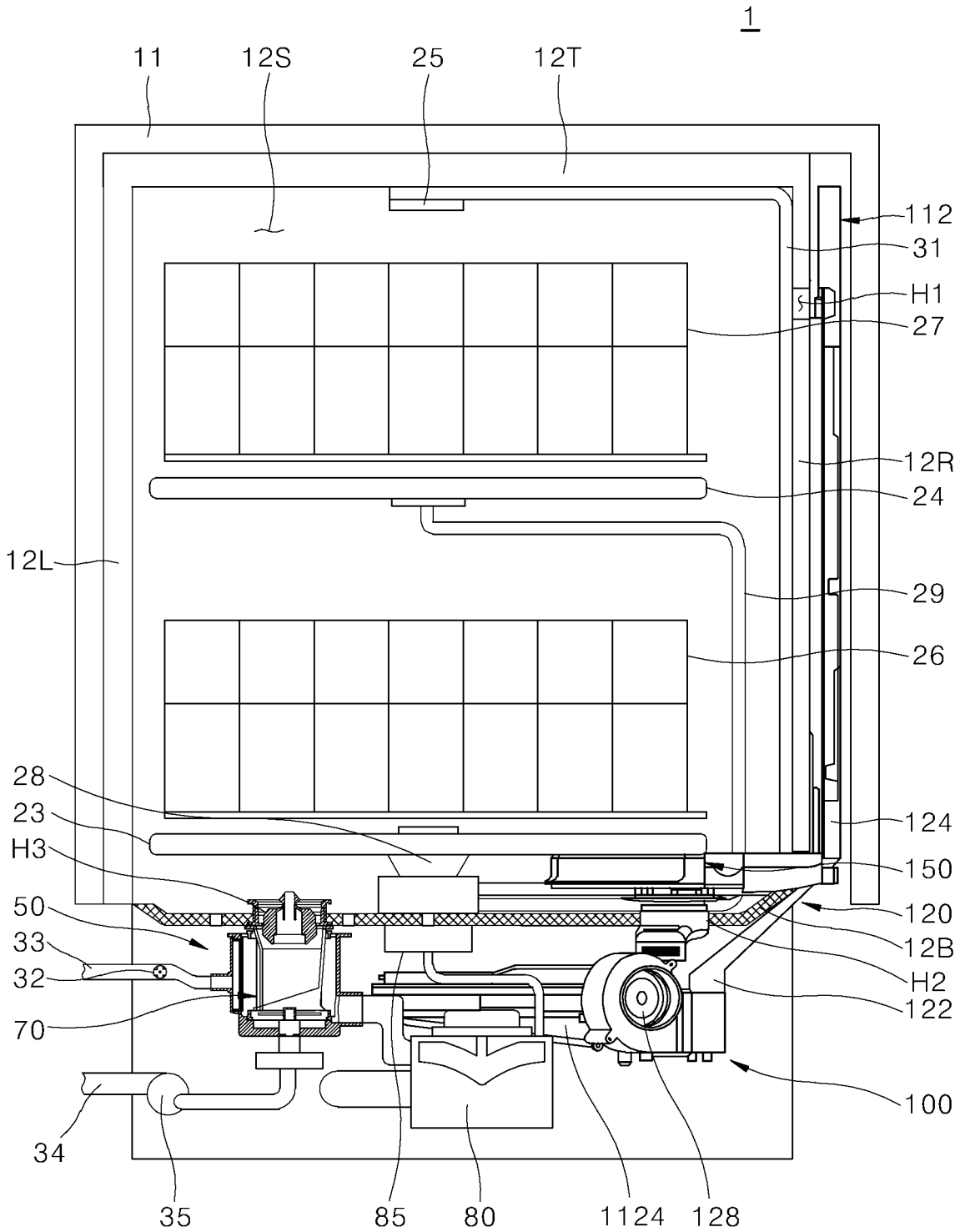
FIG. 1 is a cross-sectional view illustrating an example of a dishwasher.

Hereinafter, one or more implementations of the present disclosure will be described in detail with reference to the accompanying drawings. In the drawings, the same reference numerals are used to indicate the same or similar constituent elements.

For the convenience of description, a lateral direction of a first condensing duct 1122 to be described below is defined as a first direction, and a direction which intersects the first condensing duct 1122 (e.g., a direction which intersects an extension direction of the first condensing duct) is defined as a second direction. The first direction and the vertical direction can correspond to a direction in which an outer surface of the tub 12 facing the first condensing duct 1122 and the first condensing duct 1122 extend. The second direction can correspond to a direction in which the first condensing duct 1122 and the outer surface of the tub 12 face each other. A vertical direction, the first direction, and the second direction can intersect.

The first direction and the second direction can vary depending on the disposition of the first condensing duct 1122.

Figure 3:
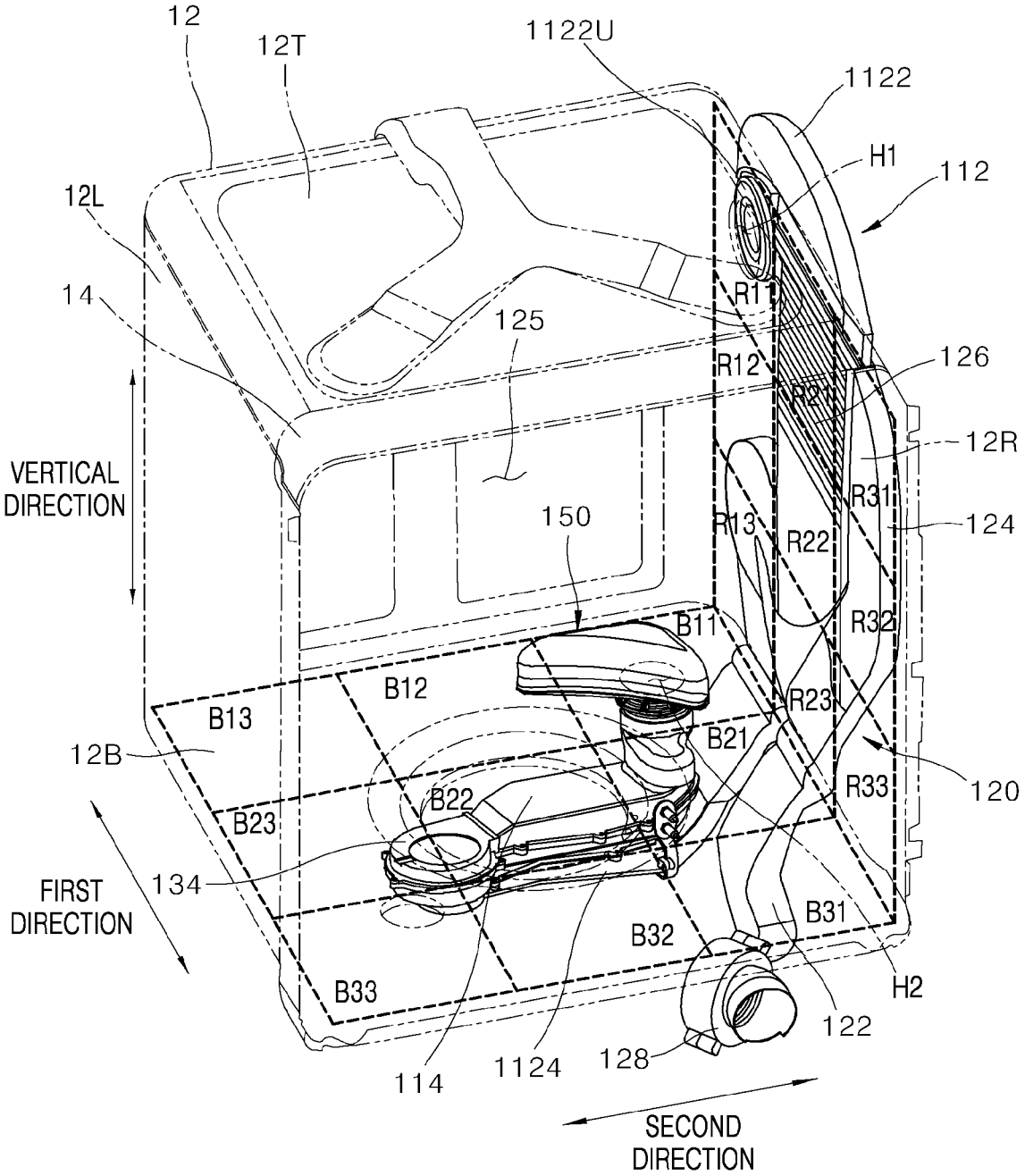
FIGS. 3 to 6 are a perspective view, a front view, a side view, and a top plan view illustrating the drying device and the tub, respectively.
Figure 4:
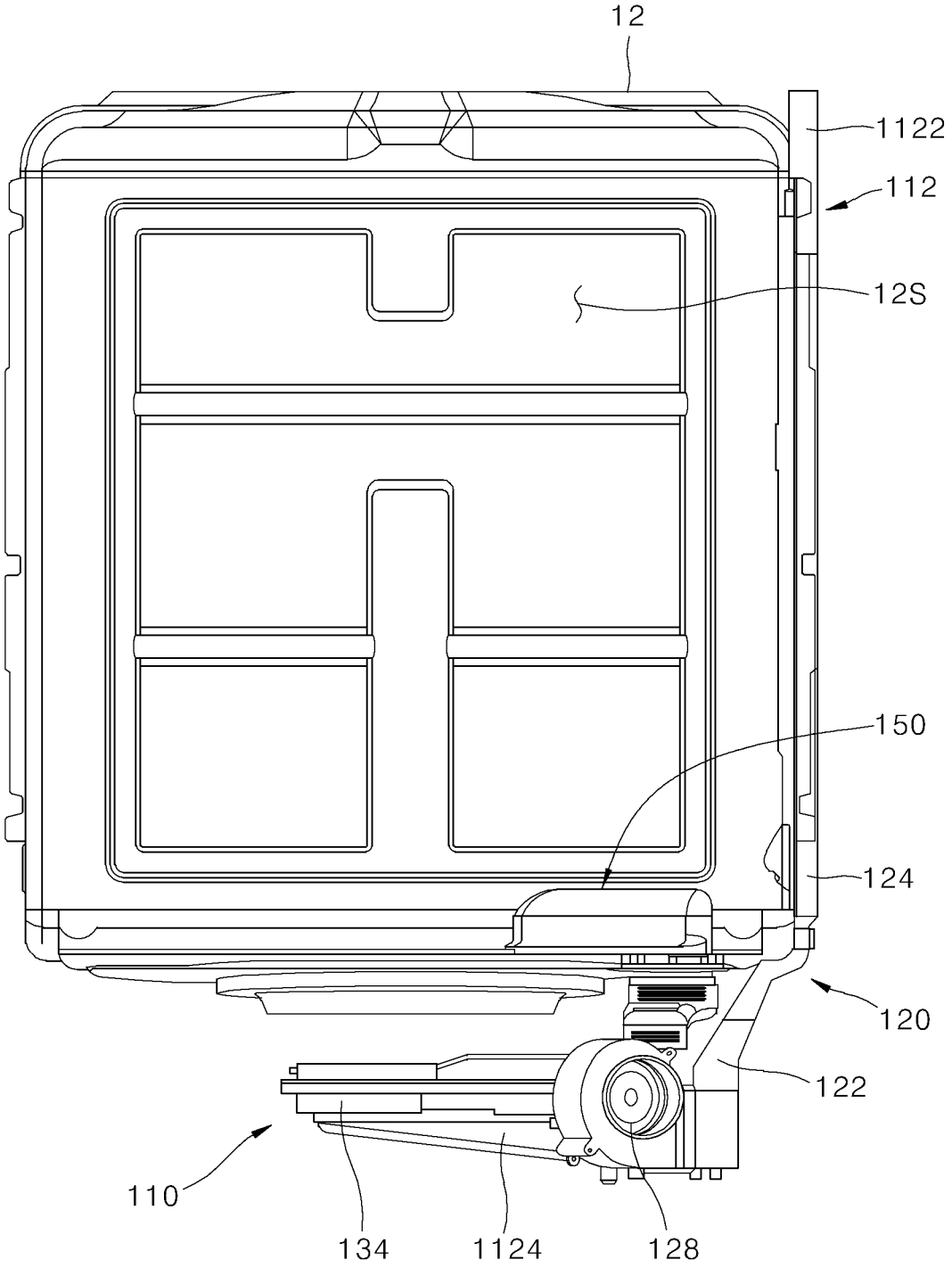

For example, when the first condensing duct 1122 is disposed to face an outer surface of one sidewall 12R of a tub 12 as illustrated in FIG. 3, the first direction can correspond to a forward/rearward direction. In this case, the forward/rearward direction is a direction toward a front surface or a rear surface of a door 14 of a dishwasher 1 in a state in which the door 14 is closed. In this case, the second direction can correspond to a leftward/rightward direction. In this case, the leftward/rightward direction is a direction toward the left and right sides in the drawings (FIGS. 1 and 4) illustrating the front surface of the door in the closed state.

As another example, unlike the drawings, when the first condensing duct 1122 is disposed to face an outer surface of a rear wall 12RR of the tub 12, the first direction can correspond to the leftward/rightward direction. In this case, the second direction can correspond to the forward/rearward direction. In this case, the leftward/rightward direction and the forward/rearward direction are as described above.

Hereinafter, a case in which the first condensing duct 1122 is disposed to face the outer surface of the one sidewall 12R of the tub 12 will be described. Therefore, the first direction can correspond to the forward/rearward direction, and the second direction can correspond to the leftward/rightward direction. However, the present disclosure is not limited thereto, and the first direction and the second direction can vary depending on a position of the first condensing duct 1122 as described above.

In some examples, a condensing duct disclosed in the claims means the first condensing duct 1122 of a condensing duct 112 to be described below, and a water drain port disclosed in the claim means a first water drain port D1 to be described below.

Hereinafter, a dishwasher according to one or more implementations of the present disclosure will be described.

FIG. 1 is a cross-sectional view illustrating an example of a dishwasher.

In some implementations, referring to FIG. 1, the dishwasher 1 can include a cabinet 11, the tub 12, a plurality of spray arms 23, 24, and 25, a sump 50, a filter 70, a washing pump 80, a switching valve 85, a water supply valve 32, a water drain pump 35, and a drying device 100. The respective components will be described.

In some examples, the cabinet 11 can define an external appearance of the dishwasher 1. The tub 12 can be disposed in the cabinet 11. In some examples, the tub 12 can have a hexahedral shape opened at a front side thereof. In other examples, the shape of the tub 12 is not limited thereto, and the tub 12 can have various shapes.

In some implementations, a washing space 12S can be defined in the tub 12 and accommodate a washing target. A door 14 (FIG. 2) for opening or closing the washing space 12S can be provided at a front side of the tub 12.

In some implementations, an inlet port H1 and an outlet port H2, which communicate with the drying device 100, can be formed in the sidewall 12R and a bottom 12B of the tub 12. In some examples, the bottom 12B of the tub 12 can have a communication hole H3 through which a washing liquid is introduced into the sump 50.

The door 14 (FIG. 2) can be disposed at the front side of the tub 12 and open or close the washing space 12S.

A plurality of racks 26 and 27 for accommodating the washing targets such as dishes can be disposed in the washing space 12S. The plurality of racks 26 and 27 can include a lower rack 26 disposed at a lower side of the washing space 12S, and an upper rack 27 disposed at an upper side of the washing space 12S. The lower rack 26 and the upper rack 27 can be disposed to be spaced apart from each other vertically and withdrawn toward a location in front of the tub 12 by sliding.

The plurality of spray arms 23, 24, and 25 can be disposed to be spaced apart from one another vertically. The plurality of spray arms 23, 24, and 25 can include a lower spray arm 23, an upper spray arm 24, and a top spray arm 25. The lower spray arm 23 can spray the washing liquid upward toward the lower rack 26. The upper spray arm 24 can be disposed above the lower spray arm 23 and spray the washing liquid upward toward the upper rack 27. The top spray arm 25 can be disposed at an uppermost end of the washing space 12S and spray the washing liquid downward.

The plurality of spray arms 23, 24, and 25 can be supplied with the washing liquid from the washing pump 80 through the plurality of spray arm connecting flow tubes 28, 29, and 31.

The sump 50 can be provided lower than the bottom 12B of the tub 12 and collect and store the washing liquid. Specifically, the sump 50 can be connected to a water supply flow path 33 and supplied with the clean washing liquid including no foreign substances through the water supply flow path 33, and the sump 50 can store the clean washing liquid. In some examples, the sump 50 can be supplied with and store the washing liquid from which foreign substances are removed by the filter 70.

The filter 70 can be disposed in the sump 50 and installed in the communication hole H3. The filter 70 can filter out foreign substances from the washing liquid containing foreign substances and moving from the tub 12 to the sump 50.

The water supply valve 32 can control the washing liquid supplied from a water source through the water supply flow path 33. When the water supply valve 32 is opened, the washing liquid supplied from the external water source can be introduced into the sump 50 through the water supply flow path 33.

In some implementations, a water drain flow path 34 can be connected to the water drain pump 35 and the sump 50. For example, the water drain pump 35 can be connected to the water drain flow path 34 and include a water drain motor. In some examples, when the water drain pump 35 operates, the foreign substances filtered out by the filter 70 or the washing liquid can be discharged to the outside through the water drain flow path 34.

The washing pump 80 can be disposed below the bottom 12B of the tub 12 and supply the plurality of spray arms 23, 24, and 25 with the washing liquid stored in the sump 50.

The switching valve 85 can selectively connect at least one of the plurality of spray arms 23, 24, and 25 to the washing pump 80.

The drying device 100 can be disposed beside one sidewall 12R and lower than the bottom 12B of the tub 12. The drying device 100 can communicate with the inside of the washing space 12S through the inlet port H1 and the outlet port H2. The drying device 100 can dry the washing space 12S in the tub 12.

In a drying step of the dishwasher 1, the moist air in the washing space 12S can be introduced into the drying device 100 through the inlet port H1, and the air dried by the drying device 100 can be introduced into the washing space 12S through the outlet port H2. The circulation of the air can be repeatedly performed. The drying device 100 can improve drying performance through the closed circulation of the air.

In some examples, a space capable of installing the drying device 100 can be narrow because various components, such as the washing pump 80, which constitute the dishwasher 1, are installed below the bottom 12B of the tub 12 and the sump 50 is provided lower than the bottom 12B of the tub 12. Therefore, the drying device 100 needs to have a compact structure having a small size so that the drying device 100 can be installed in the dishwasher 1.

A distributor 150 of the drying device 100 can be inserted into the washing space 12S through the outlet port H2. The distributor 150 can be disposed at an edge corner of the tub 12 so as not to collide with the rotating spray arm 23.

Figure 2:
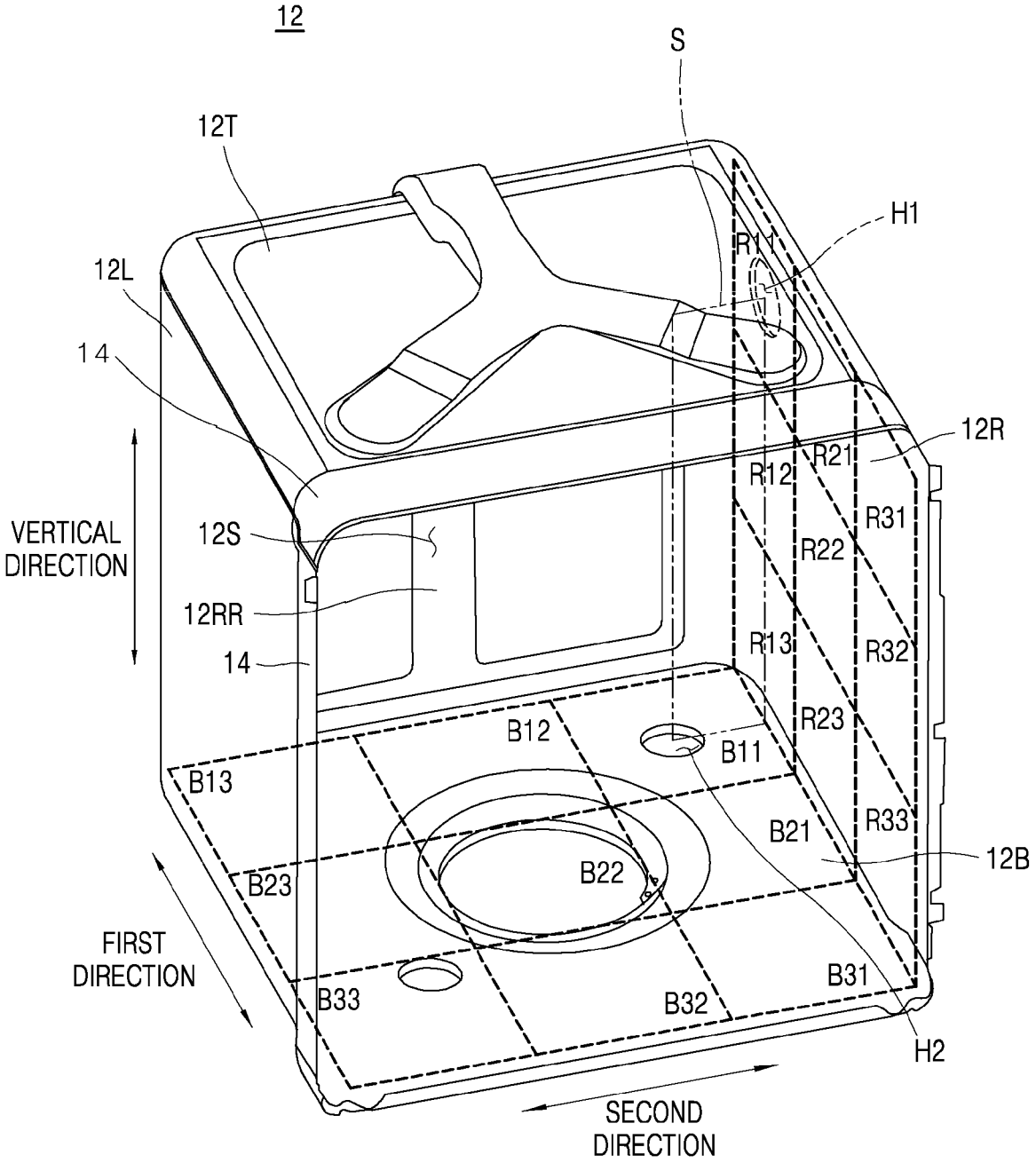
FIG. 2 is a perspective view of an example of a tub.
Figure 5:
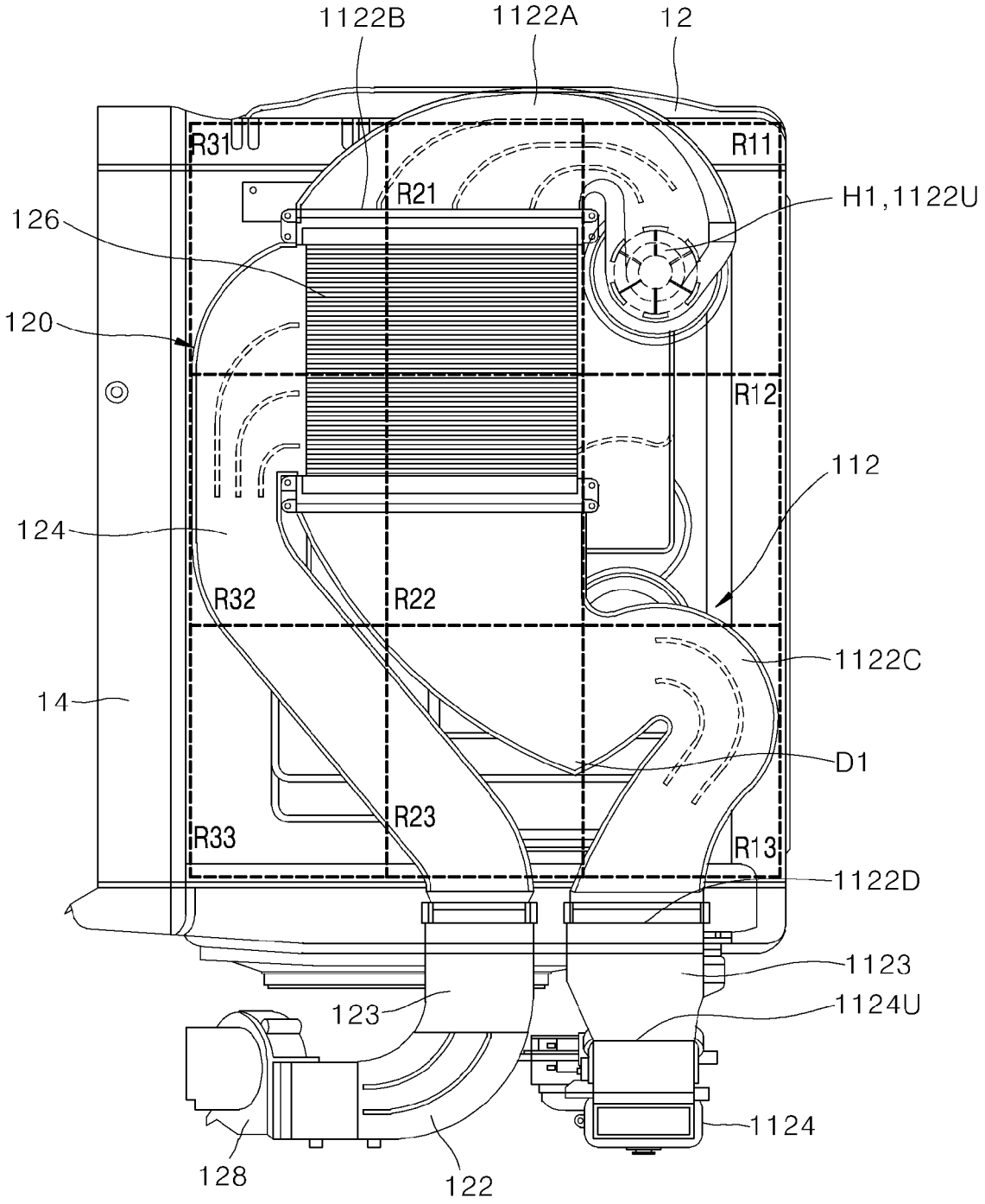
Figure 6:
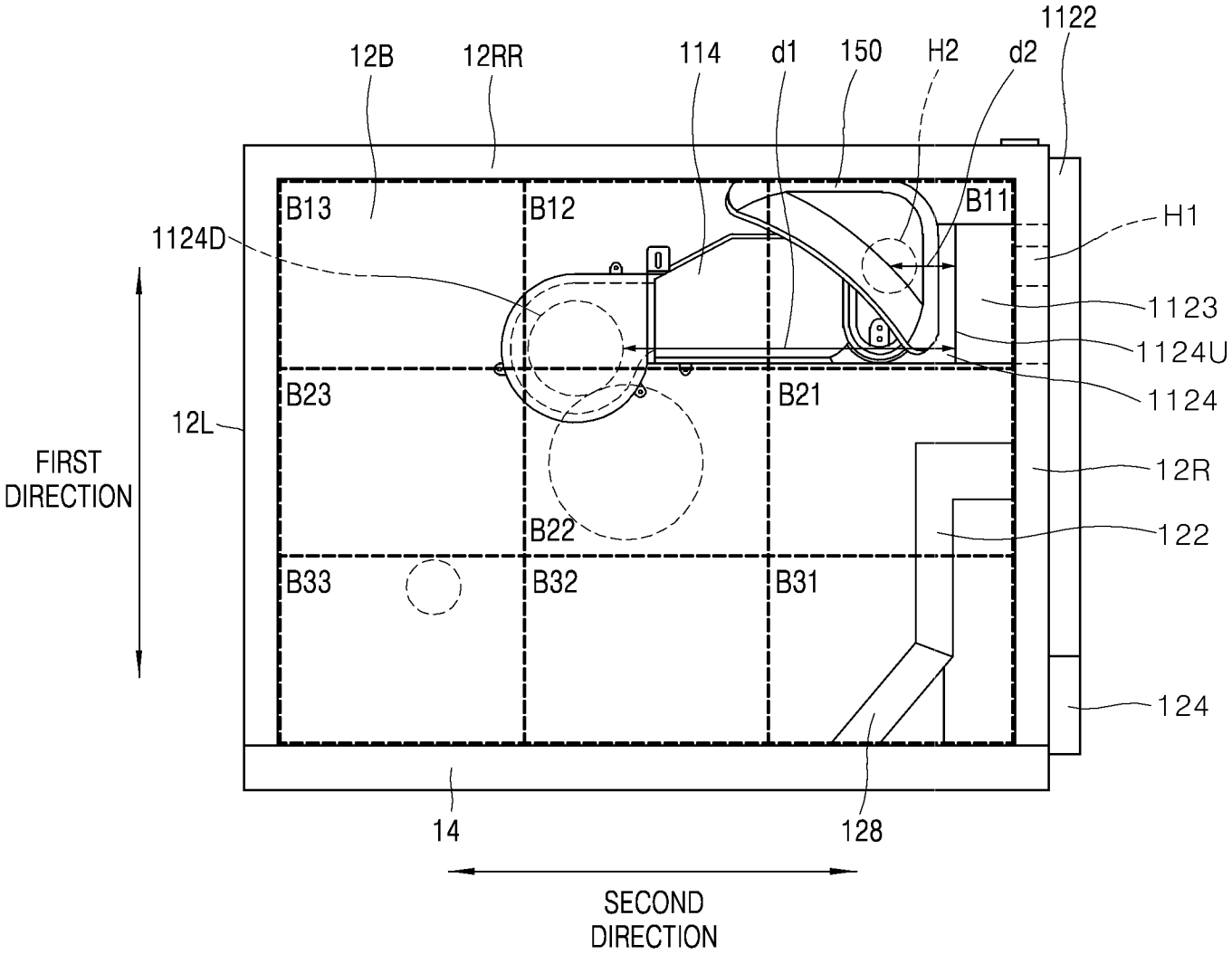
Figure 7:
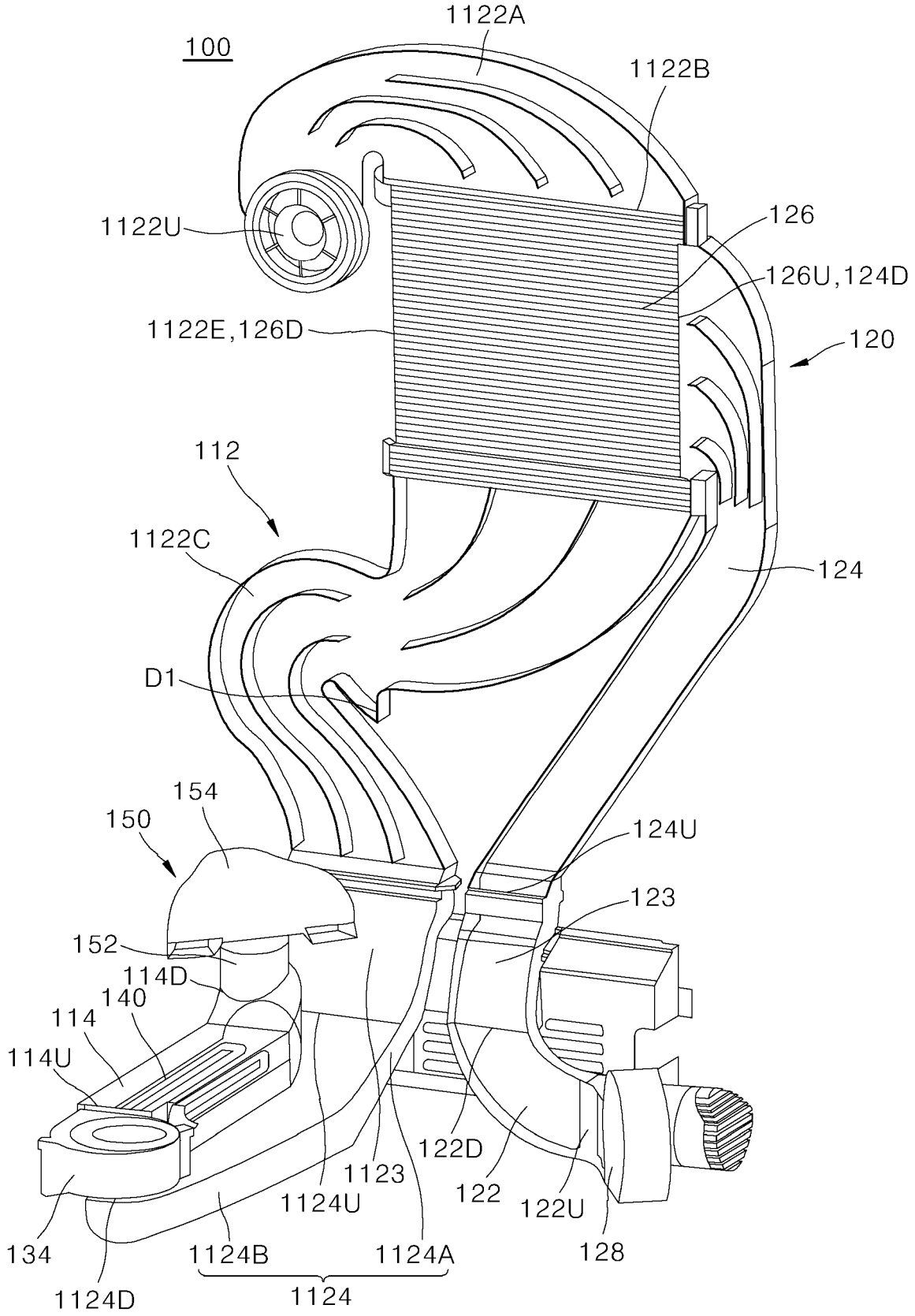
FIG. 7 is a perspective view illustrating an example of a drying device.

FIG. 2 is a perspective view illustrating an example of a tub, FIGS. 3 to 6 are respectively a perspective view, a front view, a side view, and a top plan view illustrating the drying device and the tub, and FIG. 7 is a perspective view of the drying device.

Referring to FIG. 2, the tub 12 can include the bottom 12B, an upper wall 12T, one sidewall 12R, the other sidewall 12L, and the rear wall 12RR. The washing space 12S can be defined in the tub 12 by the bottom 12B, the upper wall 12T, one sidewall 12R, the other sidewall 12L, and the rear wall 12RR. For example, one sidewall 12R can be a right sidewall of the tub 12, and the other sidewall 12L can be a left sidewall of the tub 12.

The door 14 for opening or closing the washing space 12S can be disposed at the front side of the tub 12.

The bottom 12B and the upper wall 12T can face each other in the vertical direction, the rear wall 12RR and the door 14 can face each other in the forward/rearward direction, and one sidewall 12R and the other sidewall 12L can face each other in the leftward/rightward direction. In some examples, as illustrated in FIG. 3, since the first condensing duct 1122 is disposed to face the outer surface of one sidewall 12R of the tub 12, the first direction can correspond to the forward/rearward direction, and the second direction can correspond to the leftward/rightward direction, as described above.

The inlet port H1 and the outlet port H2 can be formed in the tub 12. The outlet port H2 can be positioned lower than the inlet port H1. In this case, the lower portion can mean a height lower than a height of the inlet port H1.

Therefore, since high-temperature dry air, which is introduced into the washing space 12S through the outlet port H2, is discharged to the outside of the washing space 12S (to the inside of the drying duct) through the inlet port H1 positioned higher than the outlet port H2, the dry air (e.g., the high-temperature dry air) can be discharged after effectively circulating in the washing space 12S. Therefore, the drying efficiency can be improved.

An example of the positions of the outlet port H2 and the inlet port H1 will be specifically described below.

One sidewall 12R of the tub 12 can be divided into rear portions R11, R12, and R13, central portions R21, R22, and R23, and front portions R31, R32, and R33 in the first direction or the forward/rearward direction. A point at which the rear portion and the central portion of one sidewall 12R are separated can be a point of about ¼ to ⅓ of a width of one sidewall 12R from a rear end to a front side of one sidewall 12R. A point at which the front portion and the central portion of one sidewall 12R are separated can be a point of about ¼ to ⅓ of the width of one sidewall 12R from a front end to a rear side of one sidewall 12R.

In some examples, one sidewall 12R of tub 12 can be divided into upper portions R11, R21, and R31, central portions R12, R22, and R32, and lower portions R13, R23, and R33 in the vertical direction or an upward/downward direction. A point at which the upper portion and the central portion of one sidewall 12R are separated can be a point of about ¼ to ⅓ of a height of one sidewall 12R from an upper end to a lower side of one sidewall 12R. A point at which the lower portion and the central portion of one sidewall 12R are separated can be a point of about ¼ to ⅓ of the height of one sidewall 12R from a lower end to an upper side of one sidewall 12R.

Therefore, one sidewall 12R of the tub 12 can be divided into nine regions including a rear upper portion R11, a rear central portion R12, a rear lower portion R13, a central upper portion R21, a central portion R22, a central lower portion R23, a front upper portion R31, a front central portion R32, and a front lower portion R33 in the first direction and the vertical direction.

Like one sidewall 12R, the bottom 12B of the tub 12 can also be divided into nine regions including one rear side portion B11, a rear central portion B12, the other rear side portion B13, one central side portion B21, a central portion B22, the other central side portion B23, one front side portion B31, a front central portion B32, and the other front side portion B33 in the first direction and the second direction.

The inlet port H1 through which the air in the washing space 12S is introduced into the drying duct 110 can be formed in the rear upper portion R11 of one sidewall 12R of the tub 12. In some examples, the outlet port H2 through which the air in the drying duct 110 is discharged to the washing space 12S can be formed in one rear side portion B11 of the bottom 12B of the tub 12.

Therefore, since both the outlet port H2 and the inlet port H1 are formed in one rear side of the tub 12, a horizontal distance between the outlet port H2 and the inlet port H1 can decrease. In some examples, since the outlet port H2 is formed in the bottom 12B and the inlet port H1 is formed in the upper portion of one sidewall 12R, a vertical distance between the outlet port H2 and the inlet port H1 can increase.

In some examples, to introduce the air into the specific space and allow the introduced air to effectively circulate in the space, i) the air introduced into the inlet port can be restricted from flowing directly to the outlet port, and ii) the horizontal distance between the air inlet port and the outlet port can be decreased and the vertical distance between the inlet port and the outlet port can be described.

As described above, since the condition ii) is satisfied, the dry air introduced into the washing space 12S through the outlet port H2 can effectively circulate everywhere in the washing space 12S until the dry air is introduced into the drying device 100 through the inlet port H1, thereby improving the drying efficiency. In some examples, the condition i) can be provided by the distributor 150.

In some examples, since both the outlet port H2 and the inlet port H1 are formed at the rear side of the tub 12, the drying duct 110 can be disposed at the periphery of the rear side of the tub 12, and a cold air supply module 120 can be disposed at the periphery of the front side of the tub 12. The periphery of the rear side of the tub 12 can be blocked approximately by the wall, and the periphery of the front side of the tub 12 (particularly, the front space lower than the tub) is opened forward, such that a temperature of the air at the periphery of the front side of the tub 12 can be lower. Therefore, the cold air supply module 120 can effectively reduce humidity of the air in the drying duct 110 by using the cold air at the periphery of the front side of the tub 12, thereby improving the drying performance.

In some examples, since the outlet port H2 is formed at the rear side of the tub 12, the distributor 150 of the drying device 100 can be disposed at the rear side of the tub 12. Therefore, when the door 14 disposed at the front side of the tub 12 is opened, the distributor 150 of the drying device 100 does not obstruct a visual field. Therefore, it can be possible to improve the aesthetic appearance and easily manage various types of devices in the tub 12 without being hindered by the distributor 150 of the drying device 100.

However, the present disclosure is not limited thereto. Therefore, the positions at which the outlet port H2 and the inlet port H1 are formed are not limited to the specific regions separated in the first direction, the second direction, and the vertical direction. In some examples, the positions at which the outlet port H2 and the inlet port H1 are formed are not limited to one sidewall 12R and the bottom 12B.

The outlet port H2 can meet an imaginary vertical surface S that passes through the inlet port H1 and extends in the second direction and the vertical direction. For example, a center of the outlet port H2 can meet the imaginary vertical surface S that passes through a center of the inlet port H1 and extends in the second direction. The configuration in which the outlet port H2 meets the vertical surface S will be described below.

The outlet port H2, which has a minimum value of the horizontal distance from the inlet port H1 among the outlet ports H2 formed in the bottom 12B and spaced apart from one side end of the bottom 12B toward the other side (the other side in the second direction) by a particular distance, is the outlet port H2 that meets the imaginary vertical surface S.

When the outlet port H2 meets the vertical surface S, the horizontal distance between the outlet port H2 formed in the bottom 12B of the tub 12 and the inlet port H1 formed in one sidewall 12R of the tub 12 can be minimized, so the condition ii) is partially satisfied. Therefore the dry air introduced into the washing space 12S through the outlet port H2 can effectively circulate everywhere in the washing space 12S until the dry air is introduced into the drying device 100 through the inlet port H1. Therefore, the drying efficiency can be further improved.

Further referring to FIGS. 3 to 7, the drying device 100 can include the drying duct 110, the cold air supply module 120, a fan 130, a heater 140, and the distributor 150. However, at least one of the cold air supply module 120, the heater 140, and the distributor 150 can be omitted from the drying device 100. The respective components will be described.

The drying duct 110 communicates with the inlet port H1 and the outlet port H2 and is disposed outside the tub 12. The drying duct 110 can include the condensing duct 112 and a return duct 114.

Therefore, because the condensing duct 112 adjoins low-temperature outside air outside the tub 12, moisture vapor contained in the air flowing along the condensing duct 112 is condensed into water and then removed. Therefore, the drying performance can be improved by the simple structure and at low cost.

The condensing duct 112 can include the first condensing duct 1122 and a second condensing duct 1124.

The first condensing duct 1122 is disposed outside the tub 12 and can face the outer surface of the tub 12. Specifically, for example, the first condensing duct 1122 can face or adjoin the outer surface or the outer circumferential surface of one sidewall 12R. The first condensing duct 1122 can extend in a vertical direction and a first direction which intersects the vertical direction. The first condensing duct 1122 and the outer surface of the tub 12 can face each other in the second direction.

However, the present disclosure is not limited to this configuration. For example, as described above, the first condensing duct 1122 can face the outer surface of the rear wall 12RR. In this case, as described above, the first direction can correspond to the leftward/rightward direction, and the second direction can correspond to the forward/rearward direction.

An upstream end 1122U of the first condensing duct 1122 can communicate with the inlet port H1 of the tub 12.

Therefore, the condensing duct 112 adjoins the low-temperature air outside the tub 12, such that the moisture vapor contained in the air flowing along the condensing duct 112 is condensed into water and then removed. Therefore, the drying performance can be improved by the simple structure and at low cost.

Specifically, for example, the first condensing duct 1122 can include an upstream portion 1122A, a heat exchange portion 1122B, and a downstream portion 1122C sequentially disposed along the flow direction of the air (FIGS. 5 and 7). The upstream portion 1122A, the heat exchange portion 1122B, and the downstream portion 1122C can be three duct sections of the first condensing duct 1122.

The upstream portion 1122A can communicate with the inlet port H1, and the air can be introduced into the upstream portion 1122A.

The heat exchange portion 1122B can adjoin the cold air supply module 120. Therefore, the air in the heat exchange portion 1122B and the cold air from the cold air supply module 120 can exchange heat, such that a temperature of the air in the heat exchange portion 1122B can decrease.

However, the heat exchange is not performed only in the heat exchange portion 1122B. That is, the heat exchange can be performed even between the cold air outside the tub 12 and the air in the upstream portion 1122A and the downstream portion 1122C. In some examples, even though the cold air supply module 120 is not provided, the heat exchange can be performed between the air in the heat exchange portion 1122B and the cold air outside the tub 12.

The downstream portion 1122C can communicate with the second condensing duct 1124 and discharge the air to the second condensing duct 1124.

A first water drain port D1 can be formed in the downstream portion 1122C. Therefore, the water introduced through the inlet port H1 or the water condensed in the heat exchange portion 1122B can be discharged to the outside through the first water drain port D1, thereby improving the drying performance of the drying device 100.

A suction fan can be provided at the upstream end 1122U or the periphery of the upstream end 1122U of the first condensing duct 1122. The suction fan can be a centrifugal fan. The suction fan can improve the drying performance by allowing the air to smoothly flow. Since the centrifugal fan is provided, a transverse width (i.e. width in the second direction in the drawings) of the first condensing duct 1122 can be minimized, thereby miniaturizing the dishwasher 1.

A downstream end 1122D of the first condensing duct 1122 can be positioned in the vicinity of a lower end of the rear portion of one sidewall 12R of the tub 12. In this regard, this configuration will be described.

The cold air supply module 120 can be disposed outside the tub 12. The cold air supply module 120 can adjoin the first condensing duct 1122.

Specifically, for example, the cold air supply module 120 can include a first outside air inflow duct 122, a second outside air inflow duct 124, and a heat exchange flow path part 126 (FIGS. 5 and 7).

The first outside air inflow duct 122 can be disposed lower than the bottom 12B of the tub 12, and outside air can be introduced through an upstream end 122U.

The second outside air inflow duct 124 can face or adjoin an outer surface of one sidewall 12R of the tub 12. An upstream end 124U can communicate with a downstream end 122D of the first outside air inflow duct 122.

The heat exchange flow path part 126 can adjoin the first condensing duct 1122. In some examples, an upstream end 126U of the heat exchange flow path part 126 can communicate with a downstream end 124D of the second outside air inflow duct 124.

Figure 9:
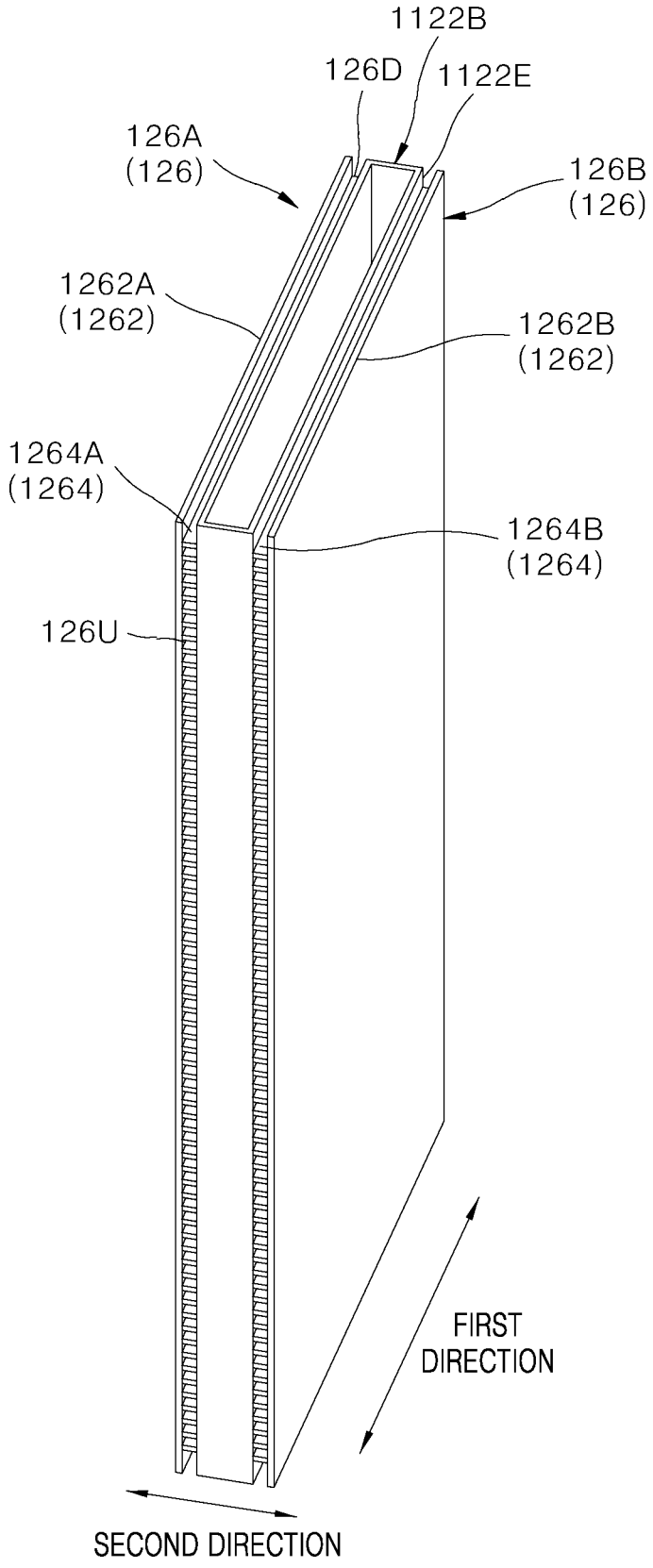
FIG. 9 is a perspective view illustrating examples of a heat exchange portion and a heat exchange flow path part disposed between a first upstream duct and a first downstream duct in the structure illustrated in FIG. 8.

Specifically, for example, the heat exchange flow path part 126 can extend along an outer circumferential surface of the first condensing duct 1122. A downstream end 126D of the heat exchange flow path part 126 can be positioned approximately in parallel in the second direction with an end 1122E in a width direction (the first direction in the drawings) of the first condensing duct 1122 (FIGS. 7 and 9). The air can be discharged to the outside through the downstream end 126D of the heat exchange flow path part 126.

Therefore, the heat exchange flow path part 126 can be configured and the installation space of the heat exchange flow path part 126 can be minimized by the simple configuration and at low cost. In some examples, a length of the heat exchange flow path part 126 is decreased, and the flow resistance is reduced, such that the cooling performance can be improved.

The cooling fan 128 can be disposed in the first outside air inflow duct 122 or at the periphery of the upstream end 122U of the first outside air inflow duct 122. The cooling fan 128 can suction the outside air and supply the outside air into the heat exchange flow path part 126.

Therefore, since the cooling fan 128 can be disposed lower than the tub 12, the cooling fan 128 can suction the cold air lower than the tub 12 and supply the cold air to the heat exchange flow path part 126, thereby improving the cooling efficiency. In some examples, because the space lower than the tub 12 is comparatively large, it can be possible to improve the cooling efficiency by increasing the size of the cooling fan 128.

In some examples, a first connection duct 123 can be disposed between the first outside air inflow duct 122 and the second outside air inflow duct 124. The first connection duct 123 can communicate with the downstream end 122D of the first outside air inflow duct 122 and the upstream end 124U of the second outside air inflow duct 124 (FIG. 7).

As described above, the dishwasher can further include the cold air supply module 120 disposed outside the tub 12 and configured to at least partially adjoin the first condensing duct 1122. Therefore, the cold air supply module 120 can effectively remove moisture vapor, which is contained in the air flowing along the first condensing duct 1122, by condensing the moisture vapor into the water. Therefore, the drying performance can be improved by the simple structure and at low cost.

In some examples, the cold air supply module 120 includes the first outside air inflow duct 122 disposed lower than the bottom 12B of the tub 12 and configured to allow the outside air to be introduced thereinto, the second outside air inflow duct 124 configured to face or adjoin the outer surface or the outer surface of one sidewall 12R of the tub 12, and the heat exchange flow path part 126 configured to adjoin the first condensing duct 1122 and communicate with the second outside air inflow duct 124. Therefore, it can be possible to effectively remove the moisture vapor contained in the air flowing along the first outside air inflow duct 122 by condensing the moisture vapor into water using the cold air lower than the tub 12. Therefore, the drying performance can be improved by the simple structure and at low cost.

The heat exchange flow path part 126 will be described in more detail with reference to FIGS. 8 and 9.

Figure 8:
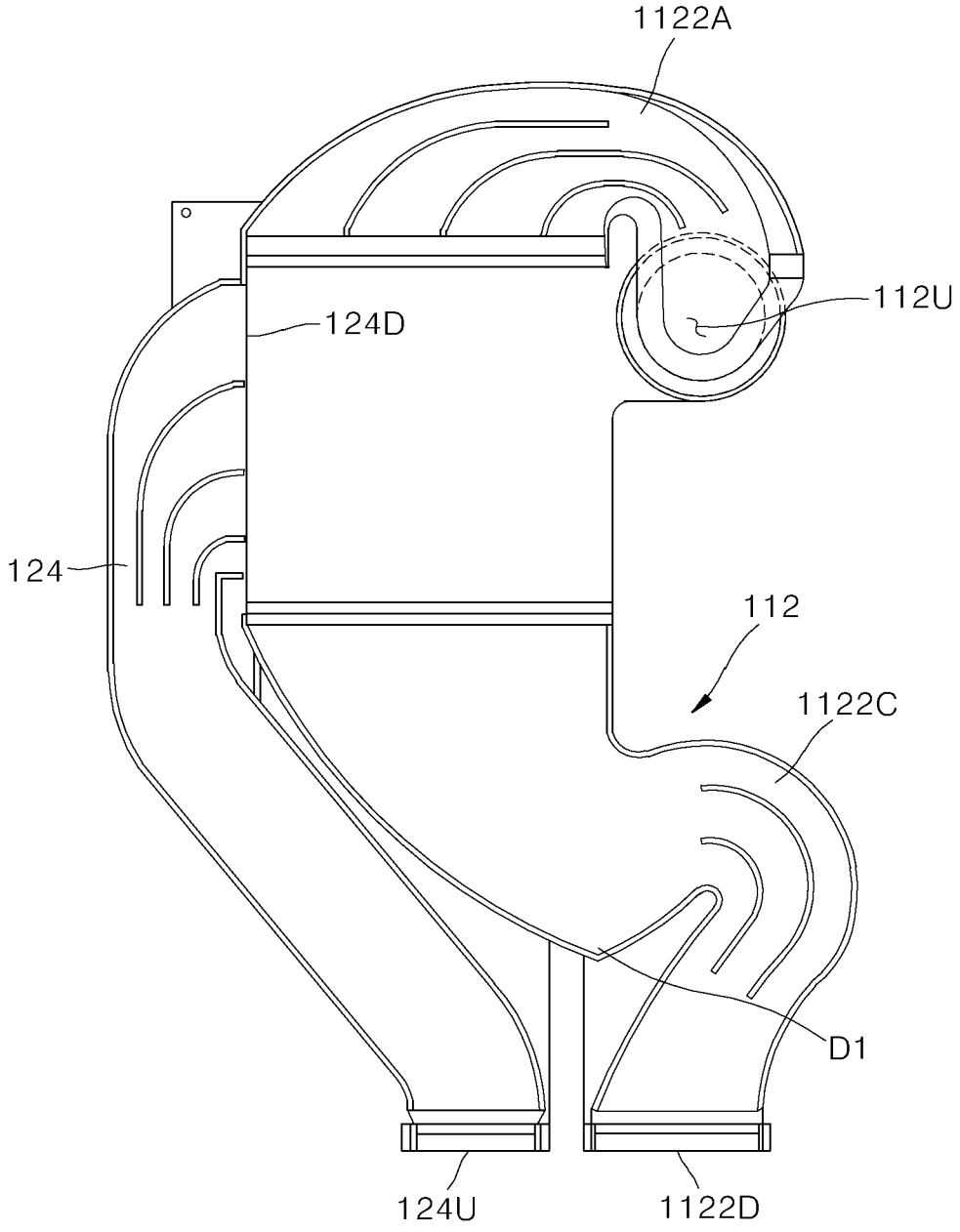
FIG. 8 is a view illustrating example components of the drying device illustrated in FIGS. 3 to 7 that are integrally manufactured.

FIG. 8 is a view illustrating example components of the drying device illustrated in FIGS. 3 to 7, which are integrally manufactured, and FIG. 9 is a perspective view illustrating examples of a heat exchange flow path part and a heat exchange portion that are disposed between the upstream portion and the downstream portion in the structure illustrated in FIG. 8.

Referring to FIG. 8, the upstream portion 1122A, the downstream portion 1122C, and the second outside air inflow duct 124 can be integrated. A vacant space can be formed between the upstream portion 1122A and the downstream portion 1122C. The heat exchange portion 1122B and the heat exchange flow path part 126, which will be described with reference to FIG. 9, can be installed in the vacant space between the upstream portion 1122A and the downstream portion 1122C.

Since the upstream portion 1122A, the downstream portion 1122C, and the second outside air inflow duct 124 are integrated as described above, the manufacturing cost of the drying device 100 can be reduced, and the drying device 100 can be easily installed and maintained.

Referring to FIG. 9, the heat exchange portion 1122B and the heat exchange flow path part 126 can be installed between the upstream portion 1122A and the downstream portion 1122C in the structure illustrated in FIG. 8.

The heat exchange portion 1122B can have a flat tubular shape opened at two opposite ends thereof and communicate vertically with the upstream portion 1122A and the downstream portion 1122C illustrated in FIG. 8.

The heat exchange flow path part 126 can include a plate 1262 and a partition wall 1264.

The plate 1262 can be disposed to face at least one of one surface and the other surface in the second direction of the heat exchange portion 1122B.

The partition wall 1264 can be provided in plural, and the plurality of partition walls 1264 can be disposed in parallel between the plate 1262 and one surface or the other surface in the second direction of the heat exchange portion 1122B.

The plate 1262 and the plurality of partition walls 1264 can extend along the outer circumferential surface of the heat exchange portion 1122B in the width direction (the first direction in the drawings) of the heat exchange portion 1122B that intersects the flow direction of the air flowing in the heat exchange portion 1122B.

When the heat exchange portion 1122B and the heat exchange flow path part 126 illustrated in FIG. 9 are installed in the vacant space between the upstream portion 1122A and the downstream portion 1122C of the structure illustrated in FIG. 8, the downstream end 124D of the second outside air inflow duct 124 can adjoin a lateral end in the first direction of the heat exchange portion 1122B and the plate 1262. Therefore, the cold air introduced into the second outside air inflow duct 124 can flow to the vacant space between the plate 1262 and the heat exchange portion 1122B. In this case, a plurality of flow paths can be formed between the plate 1262 and the heat exchange portion 1122B by the plurality of partition walls 1264 extending in the width direction (the first direction in the drawings) of the heat exchange portion 1122B.

That is, the cold air introduced into the second outside air inflow duct 124 can flow along the plurality of flow paths formed by the heat exchange portion 1122B, the plate 1262, and the plurality of partition walls 1264. The direction in which the cold air flows along the plurality of flow paths formed by the heat exchange flow path part 126 can intersect the direction in which the moist air flows along the heat exchange portion 1122B.

In this case, as described above, the downstream end 126D of the heat exchange flow path part 126 can be positioned approximately in parallel in the second direction with the end 1122E in the width direction (the first direction in the drawings) of the first condensing duct 1122 (FIG. 9).

As described above, the heat exchange flow path part 126 includes the plate 1262 disposed to face at least one of one surface and the other surface in the second direction of the heat exchange portion 1122B, and the plurality of partition walls 1264 disposed in parallel between the plate 1262 and one surface or the other surface in the second direction of the heat exchange portion 1122B. Therefore, heat exchange flow path part 126 can be configured by the simple configuration and at low cost. In some examples, since the cold air flows along the outer circumferential surface of the heat exchange portion 1122B, the heat exchange efficiency can be improved. In some examples, since the cold air flows along the plurality of flow paths separated from one another, the heat exchange is uniformly performed in a wide area, such that the heat exchange efficiency can be improved.

In some examples, as illustrated in FIG. 9, since the heat exchange portion 1122B and the heat exchange flow path part 126 are manufactured separately and then installed between the upstream portion 1122A and the downstream portion 1122C of the structure illustrated in FIG. 8, the drying device 100 can be easily manufactured, replaced, and repaired. Therefore, the manufacturing cost can be reduced, and the maintenance can be easily performed.

The upstream portion 1122A, the heat exchange portion 1122B, and the downstream portion 1122C will be described in more detail with reference to FIGS. 10 to 13.

Figure 10:
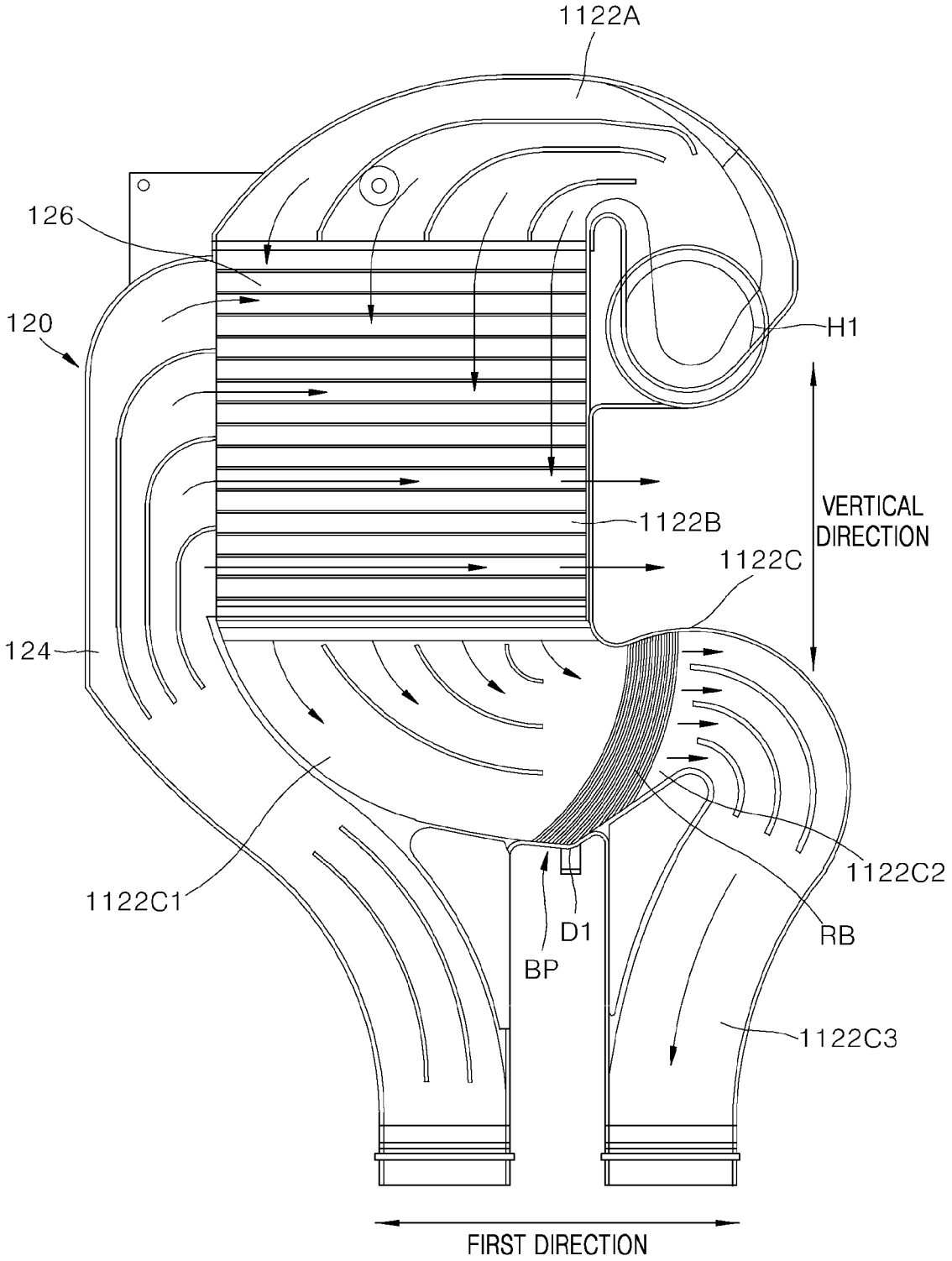
FIG. 10 is a side view illustrating examples of a tub and a part of a drying device.
Figure 11:
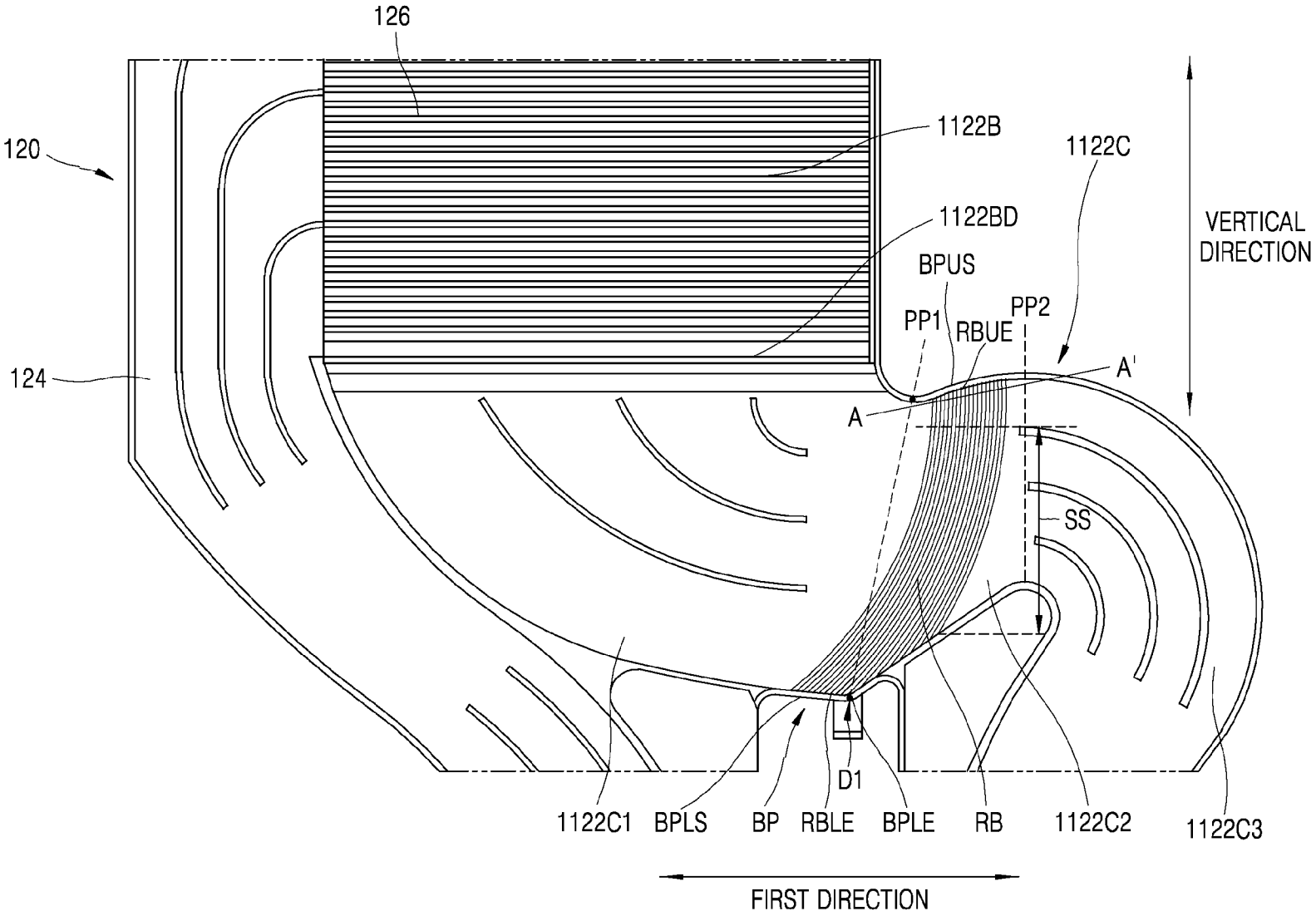
FIG. 11 is an enlarged view of a part of the drying device in the FIG. 10.
Figure 12:
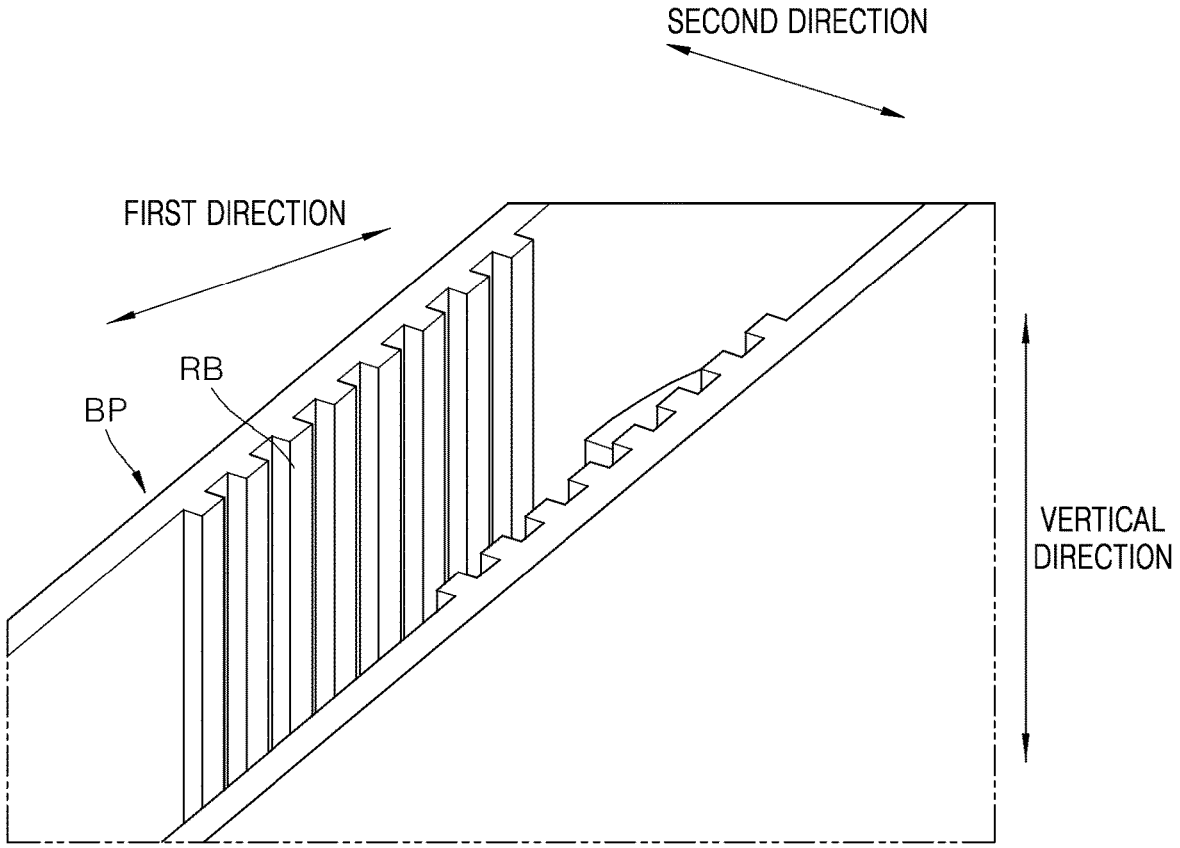
FIG. 12 is a cross-sectional view taken along line A-A' indicated in FIG. 11.
Figure 13:
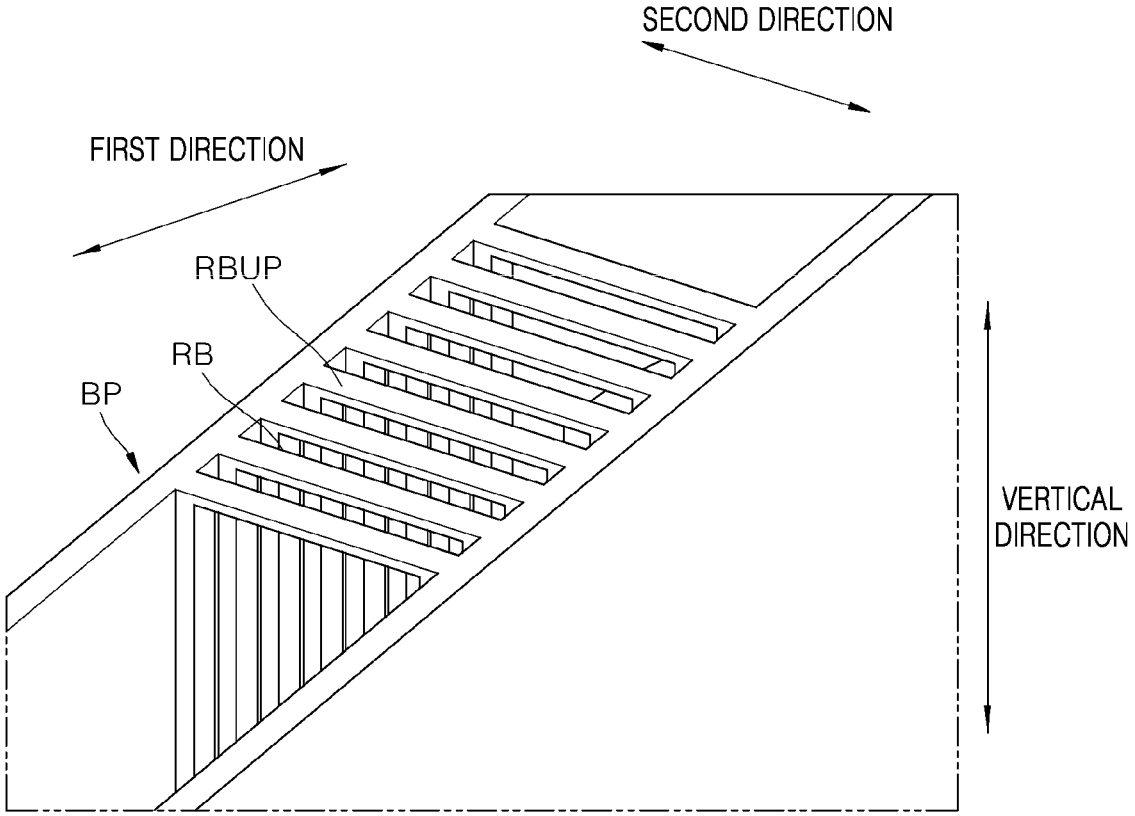
FIG. 13 is a view of another implementation of the cross-sectional view of FIG. 12.

FIG. 10 is a view illustrating a part of an example of a drying device. FIG. 11 is an enlarged view of a part of the FIG. 10. FIG. 12 is a cross-sectional view taken along line A-A' indicated in FIG. 11. FIG. 13 is a cross-sectional view of an example of a drying device taken along line A-A' indicated in FIG. 11.

Hereinafter, unless otherwise specified, the description with reference to FIGS. 1 to 9 will apply to the following description.

Referring to FIG. 10, as described above, the first condensing duct 1122 can include the upstream portion 1122A, the heat exchange portion 1122B, and the downstream portion 1122C.

An upstream end of the upstream portion 1122A can communicate with the inlet port H1. For example, an upstream end of the upstream portion 1122A can be coupled directly to the inlet port H1.

The upstream portion 1122A can be bent from the inlet port H1 and extend. For example, the upstream portion 1122A can be bent and extended by approximately 180 degrees in the first direction and the vertical direction.

The heat exchange portion 1122B can be connected to the upstream portion 1122A and extend downward. In this case, the downward direction can mean the vertically downward direction or the inclined downward direction. Therefore, the air can approximately descend in the heat exchange portion 1122B.

Since the heat exchange portion 1122B extends downward as described above, the water condensed in the heat exchange portion 1122B can fall or flow downward by gravity, such that the condensate water can be easily collected and quickly discharged to the outside. Therefore, the drying efficiency can be improved.

The heat exchange portion 1122B can adjoin the heat exchange flow path part 126 of the cold air supply module 120. However, the present disclosure is not limited to this configuration.

The heat exchange portion 1122B can communicate with the downstream portion 1122C.

The downstream portion 1122C can communicate with the upstream portion 1122A. For example, the downstream portion 1122C can communicate with the downstream end of the upstream portion 1122A. Specifically, for example, the downstream portion 1122C can communicate with a downstream end 1122BD of the heat exchange portion 1122B that extends from the downstream end of the upstream portion 1122A.

The downstream portion 1122C can include a bent portion BP which is bent to descend and then ascend. That is, the bent portion BP can sequentially include a descending portion (hereinafter, referred to as a 'descending duct portion') and an ascending portion (hereinafter, referred to as an 'ascending duct portion'). Therefore, the air can descend and then ascend in the bent portion BP.

Therefore, the water introduced through the inlet port H1 or the water condensed in the upstream portion 1122A or the heat exchange portion 1122B can be easily collected at a particular point on a lower surface BPLS of the bent portion BP and then discharged to the outside, which makes it possible to improve the drying performance. In some examples, since the bent portion BP is bent to descend and then ascend, the introduced water or the condensed water hardly passes through the bent portion BP due to the weight of the water. Therefore, the water cannot be introduced into the downstream side of the condensing duct 1122 by passing over the bent portion BP. Therefore, it can be possible to improve the drying performance of the drying device 100, prevent the drying device 100 from being broken down by the water, and inhibit proliferation of bacteria or mold in the condensing duct 112.

The first water drain port D1 can be formed at the lower end of the bent portion BP. Therefore, the water introduced through the inlet port H1 or the water condensed in the upstream portion 1122A or the heat exchange portion 1122B can be collected on the lower surface BPLS of the bent portion BP and then quickly and easily discharged through the first water drain port D1 formed at the lower end of the lower surface BPLS, which makes it possible to improve the drying performance.

The bent portion BP can extend toward one side in the first direction which is the lateral direction of the condensing duct 1122. That is, the bent portion BP can extend downward, upward, and toward one side in the first direction so as to be bent to describe and then ascend.

In this case, the first water drain port D1 and a lower end BPLE of the bent portion BP can be closer to one end of two opposite ends in the first direction of the heat exchange portion 1122B.

Therefore, an inclination of a lower surface of a descending duct portion 1122C1 can be gentle, such that the flow direction of the air can be slowly changed. Therefore, the flow resistance can be reduced, which makes it possible to improve the drying efficiency and energy efficiency.

One or more ribs RB can be formed in the bent portion BP, protrude in the second direction, and traverse the bent portion BP.

Therefore, the water is interfered by the rib RB, which makes it possible to help to prevent the water from passing through the bent portion BP and being introduced into the downstream side of the condensing duct 112. Therefore, it can be possible to improve the drying performance of the drying device 100, help to prevent the drying device 100 from being broken down by the water, and help to prevent proliferation of bacteria or mold in the condensing duct 112.

The rib RB can protrude inward from two opposite lateral surfaces of the bent portion BP disposed in the second direction (FIGS. 12 and 13).

Therefore, since the water is effectively interfered by the rib RB formed on the two opposite surfaces of the bent portion BP, it can be possible to help to prevent the water from passing through the bent portion BP and being introduced into the downstream side of the condensing duct 1122.

The rib RB can traverse the bent portion BP up and down.

Therefore, since the extension direction of the rib RB intersects the flow direction of the air in the bent portion BP, the water is interfered by the rib RB, such that the water can be blocked from passing through the bent portion BP. In particular, since the extension direction of the rib RB can approximately perpendicular to the flow direction of the air in the bent portion BP, the water can be effectively interfered by the rib RB. In some examples, since the water, which interferes with the rib RB, flows downward along the rib RB by the weight of the water, the water can be easily collected on the lower surface BPLS of the bent portion BP and then discharged to the outside.

The rib RB can adjoin at least one of the lower surface BPLS and an upper surface BPUS of the bent portion BP.

Therefore, it can be possible to block the water from passing through the bent portion BP, which flows along the lateral surfaces of the bent portion BP disposed in the second direction in the vicinity of the lower surface BPLS or the upper surface BPUS of the bent portion BP or which flows along the lower surface BPLS or the upper surface BPUS of the bent portion BP in the vicinity of the lateral surfaces of the bent portion BP disposed in the second direction.

An upper end RBUP of the rib RB can protrude in the second direction while adjoining the upper surface BPUS of the bent portion BP (FIG. 13).

Therefore, it can be possible to block the water from flowing along the upper surface BPUS of the bent portion BP and passing through the bent portion BP.

Lower end RBLE of the rib RB can be positioned in the vicinity of the first water drain port D1.

Therefore, the water, which is interfered by the rib RB, flows to the vicinity of the first water drain port D1 along the rib RB by the weight of the water, such that the water can be quickly and easily collected and then discharged to the outside.

As described above, the bent portion BP can extend toward one side in the first direction. In this case, upper end RBUE of the rib RB can be positioned at one side of the lower end RBLE of the ribs RB in the first direction (FIG. 11).

Therefore, the rib RB can be positioned such that the upper end RBUE of the rib RB is closer to the downstream side of the bent portion BP than is the lower end RBLE. Therefore, for example, even though the lower end RBLE of the rib RB is positioned in the vicinity of the first water drain port D1 without being positioned at the downstream side of the bent portion BP, the upper end RBUE of the rib RB can be positioned at the downstream side of the bent portion BP. Therefore, the condensate water, which is produced at the downstream side of the bent portion BP, is also interfered by the rib RB and cannot pass through the bent portion BP. Therefore, the drying performance can be improved.

The rib RB can include a height section SS at which a gradient of the rib RB increases as the height increases.

Therefore, since the gradient of the rib RB is large at the upper portion of the height section SS, the water can easily flow downward along the rib RB by the weights of the water even though a small amount of water is interfered by the rib RB. In contrast, since the water is collected at the lower portion of the height section SS and the amount of water increases, the water can easily flow downward along the rib RB by the weight of the water even though the gradient of the rib RB is small at the lower portion of the height section SS. Therefore, since the water can be quickly and easily collected and then discharged to the outside, the drying performance can be improved.

In some examples, the height section SS enables the upper end RBUE of the rib RB to be positioned at one side of the lower end RBLE of the rib RB in the first direction, which makes it possible to improve the drying performance as described above.

In some examples, at the height section SS, the gradient of the rib RB can be approximately perpendicular to the flow direction of the air in the bent portion BP, such that the water can be effectively interfered by the rib RB.

In some examples, the height section SS illustrated in FIG. 11 is a common height section at which the gradients of the plurality of ribs RB increase as the height increase. Therefore, in FIG. 11, an actual height section at which the gradient increases as the height increases for each of the rib RB can further include a height section from a height of the lower end RBLE of each of the rib RB to a height of the lower end of the height section SS illustrated in FIG. 11.

The bent portion BP can include a descending duct portion 1122C1 and an ascending duct portion 1122C2.

The descending duct portion 1122C1 can communicate with the upstream portion 1122A and extend downward to be inclined toward one side in the first direction. For example, an upstream end of the descending duct portion 1122C1 can communicate with the upstream portion 1122A or the heat exchange portion 1122B.

An upstream end of the ascending duct portion 1122C2 can communicate with the downstream side of the descending duct portion 1122C1 and extend upward to be inclined toward one side in the first direction. For example, the upstream end of the ascending duct portion 1122C2 can communicate with the downstream end of the descending duct portion 1122C1.

The descending duct portion 1122C1 and the ascending duct portion 1122C2 can be separated by an imaginary first partition PP1.

In this case, the upper end RBUE of the rib RB can be positioned in the ascending duct portion 1122C2.

Therefore, at least a portion of the rib RB is positioned in the ascending duct portion 1122C2 in which the water is easily separated from the air by the weight of the water, such that the water is effectively interfered by the rib RB, thereby blocking the water from passing through the bent portion BP. In some examples, the upper end RBUE of the rib RB can be positioned at one side of the lower end RBLE of the rib RB in the first direction when the upper end RBUE of the rib RB is positioned in the ascending duct portion 1122C2. Therefore, the drying performance can be improved, as described above.

The plurality of ribs RB can be formed in parallel in the bent portion BP.

Therefore, the water is interfered by the plurality of ribs RB, which makes it possible to block the water from passing through the bent portion BP and being introduced into the downstream side of the condensing duct 112. Therefore, it can be possible to improve the drying performance of the drying device 100, help to prevent the drying device 100 from being broken down by the water, and reduce or prevent proliferation of bacteria or mold in the condensing duct 112.

At least one rib RB can extend to the vicinity of the first water drain port D1.

Therefore, the water, which is interfered by the rib RB, can easily flow to the vicinity of the water drain port D1 along the rib RB by the weight of the water, such that the water can be quickly and easily collected and then discharged to the outside. Therefore, the drying performance can be improved.

Figure 14:
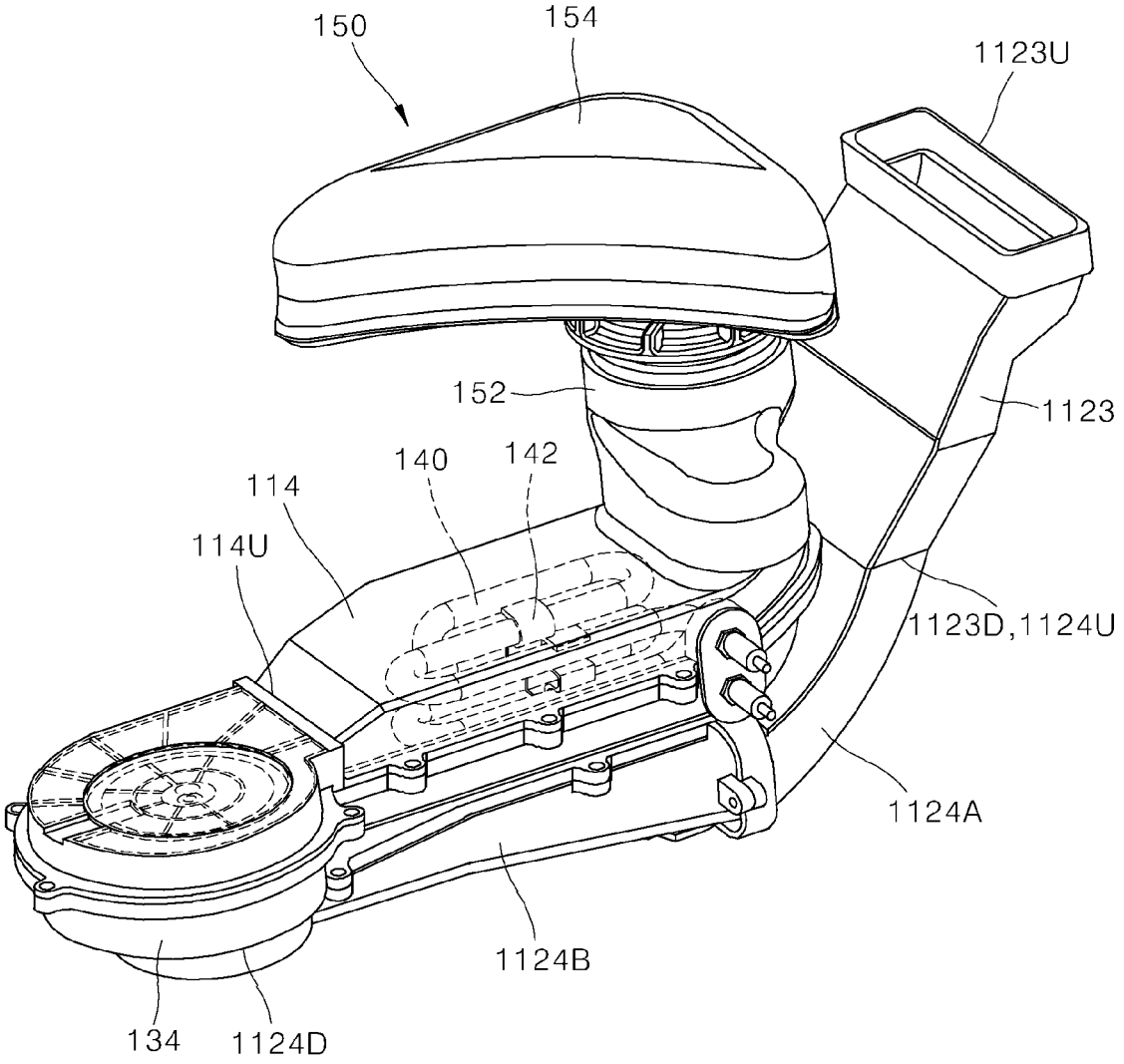
FIG. 14 is a perspective view illustrating examples of a second connection duct, a second condensing duct, a return duct, a fan housing, a heater, a distributor, and a thermal conductor.
Figure 15:
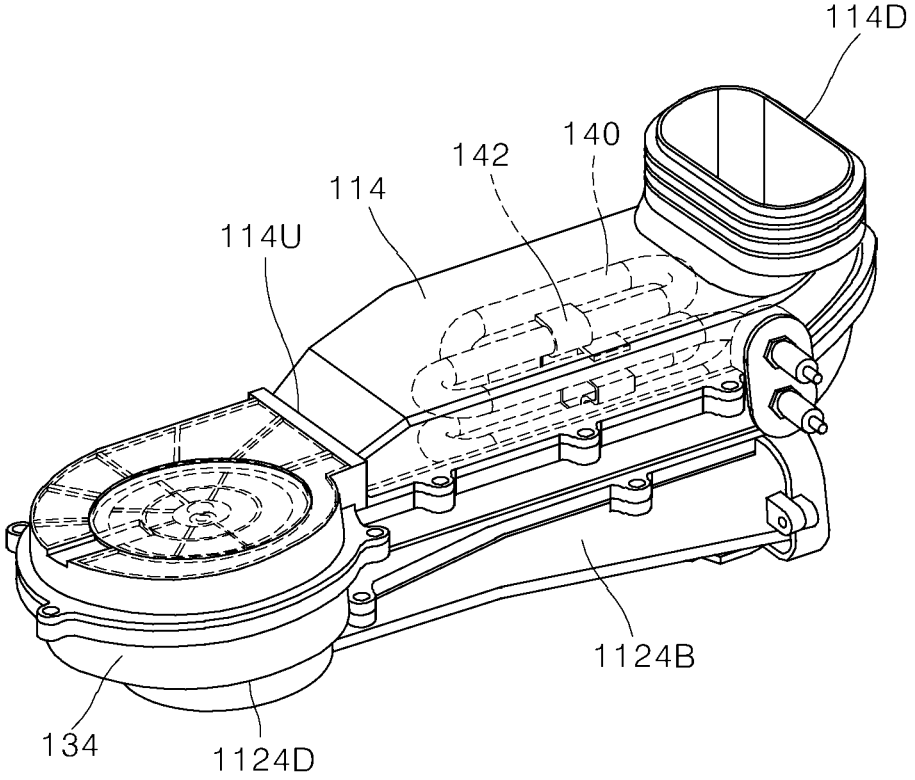
FIGS. 15 to 17 are respectively a perspective view, a top plan view, and a cross-sectional view illustrating examples of a downstream duct portion, the return duct, the fan housing, the heater, and the thermal conductor.
Figure 16:
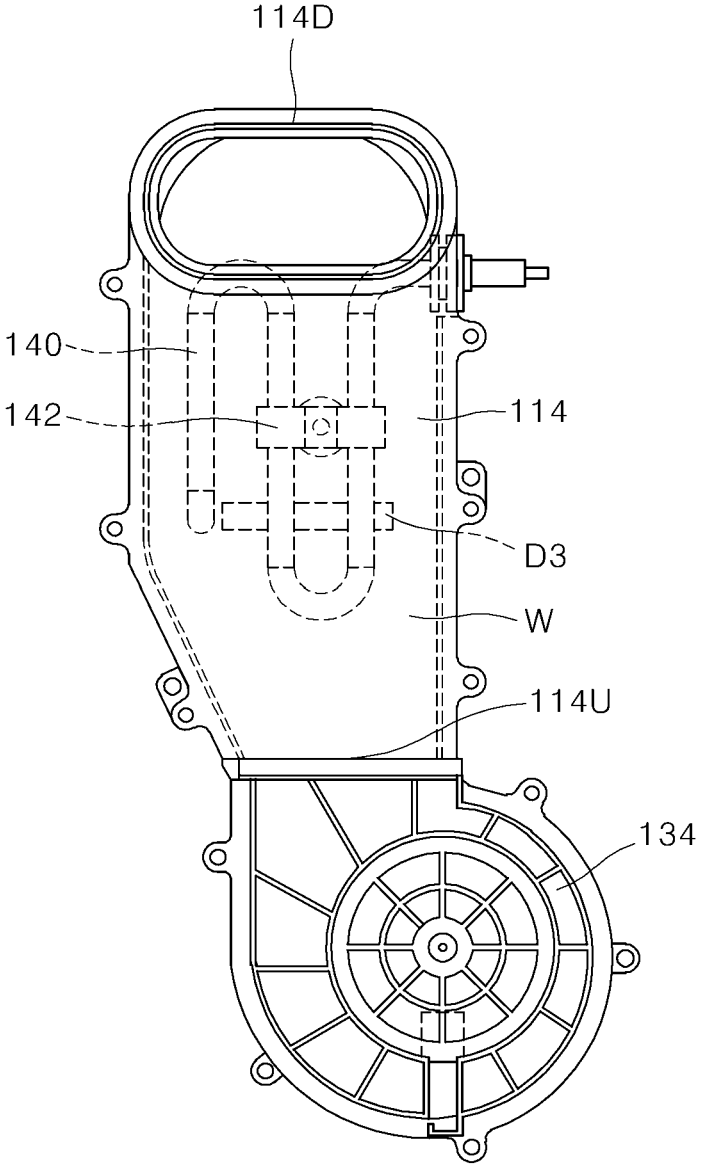
Figure 17:
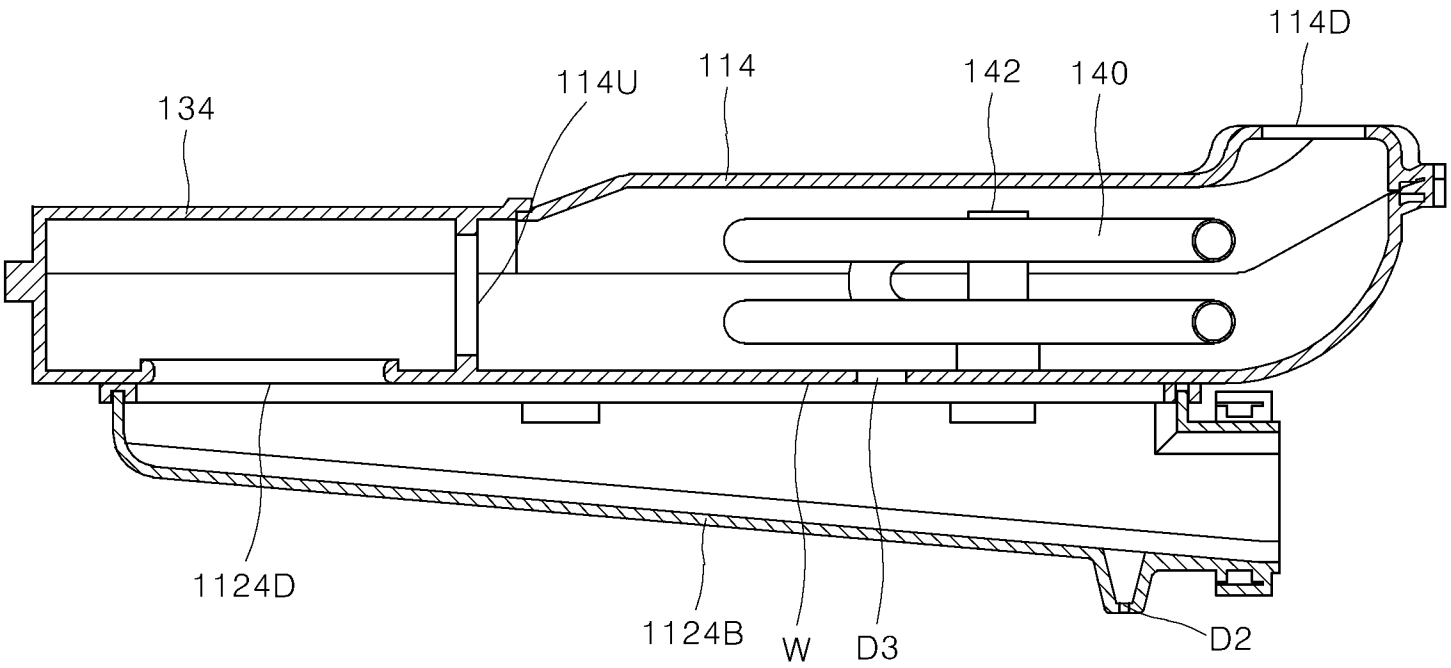
Figure 18:
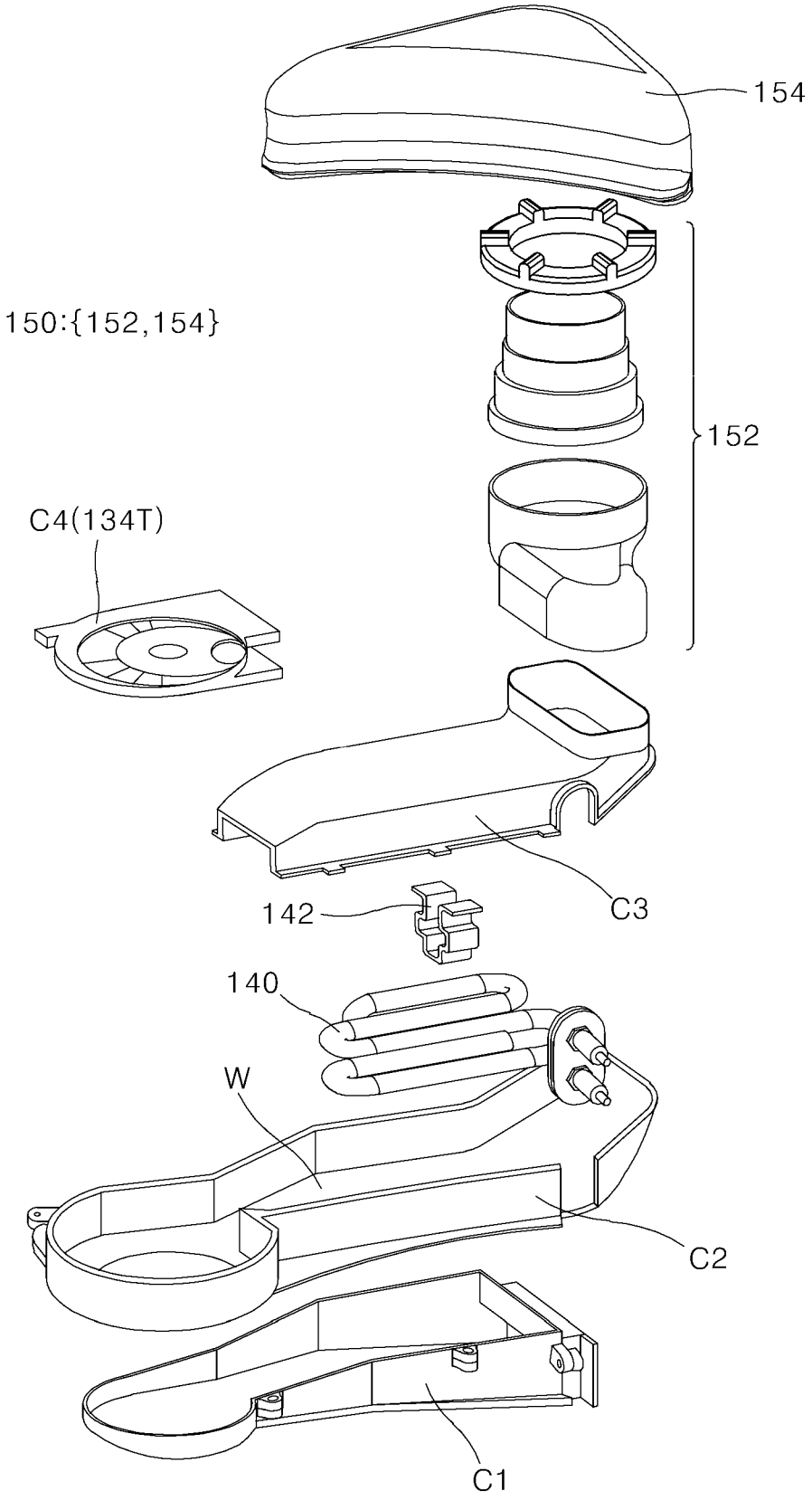
FIG. 18 is an exploded perspective view illustrating the downstream duct portion, the return duct, the fan housing, the heater, the distributor, and the thermal conductor.
Figure 19:
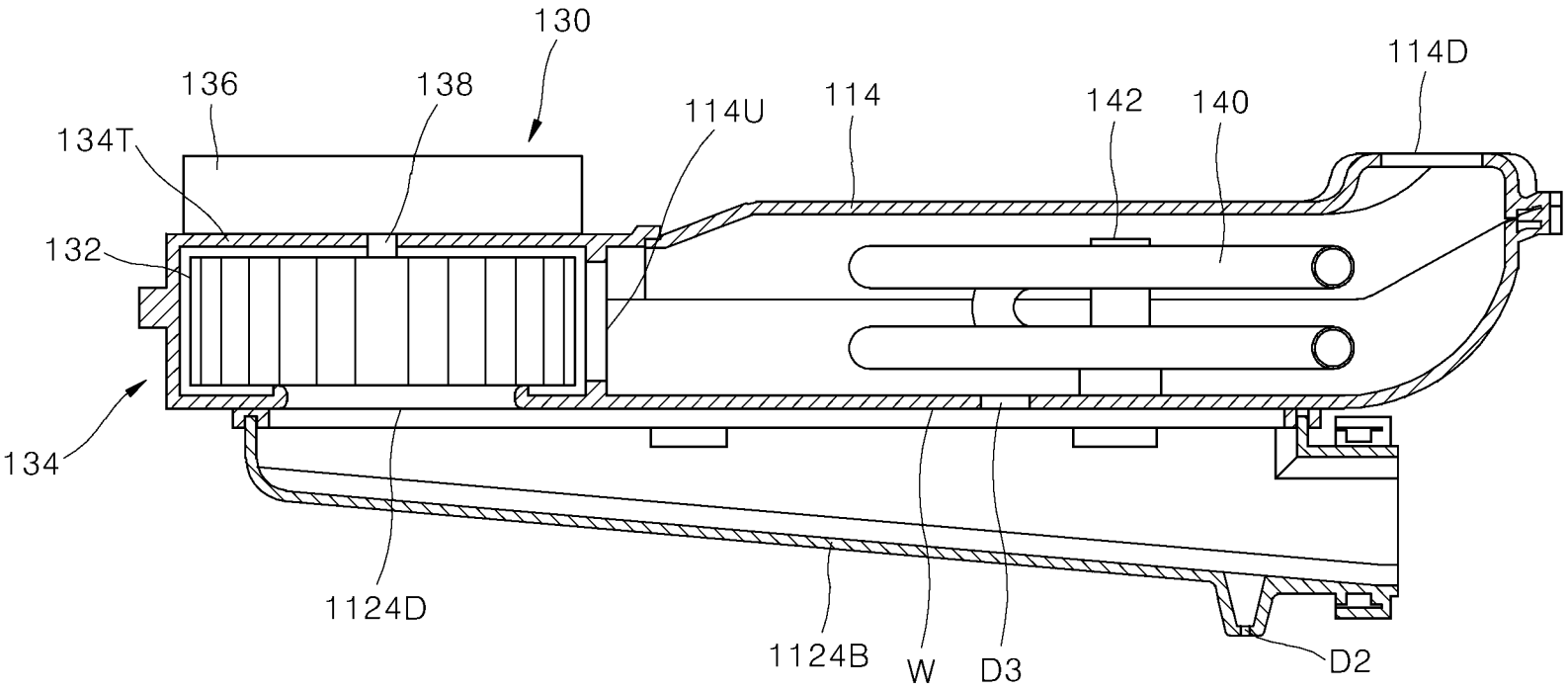
FIG. 19 is a cross-sectional view illustrating examples of a fan blade and a motor that are installed in the fan housing illustrated in FIG. 17.

FIG. 14 is a perspective view illustrating examples of a second connection duct, the second condensing duct, the return duct, a fan housing, the heater, and the distributor, and FIGS. 15 to 17 are a perspective view, a top plan view, and a cross-sectional view illustrating a downstream duct portion, the return duct, the fan housing, and the heater. FIG. 18 is an exploded perspective view illustrating examples of the downstream duct portion, the return duct, the fan housing, the heater, and the distributor. FIG. 19 is a cross-sectional view illustrating examples of a fan blade and a motor that are installed in the fan housing illustrated in FIG. 17.

Further referring to FIGS. 14 to 19, the second condensing duct 1124 can be disposed lower than the bottom 12B of the tub 12. An upstream end 1124U of the second condensing duct 1124 can communicate with the downstream end 1122D of the first condensing duct 1122 (FIGS. 5 and 7).

Therefore, the condensing duct 112 adjoins the low-temperature air lower than the bottom 12B of the tub 12, such that the moisture vapor contained in the air flowing along the condensing duct 112 is condensed into water and then removed. Therefore, the drying performance can be improved by the simple structure and at low cost.

Specifically, for example, the second condensing duct 1124 can include an upstream duct portion 1124A and a downstream duct portion 1124B sequentially disposed along the flow direction of the air (FIGS. 7 and 14). The upstream duct portion 1124A and the downstream duct portion 1124B can be two duct sections of the second condensing duct 1124.

The upstream duct portion 1124A can communicate with the downstream end 1122D of the first condensing duct 1122 (FIGS. 5, 7, and 14). The upstream duct portion 1124A can be inclined approximately downward along the flow direction of the air.

The downstream duct portion 1124B can communicate with the return duct 114. The downstream duct portion 1124B can be approximately parallel to the horizontal plane or inclined upward along the flow direction of the air.

However, the present disclosure is not limited to this configuration. For example, the second condensing duct 1124 can be configured to include only a section parallel to the horizontal plane or inclined upward like the downstream duct portion 1124B. In this case, the downstream duct portion 1124B can be the second condensing duct 1124.

The second condensing duct 1124 can be bent in the vicinity of a downstream end 1124D and extend in an approximately vertical direction (e.g., upward). Therefore, it can be possible to block the water, which is introduced into the second condensing duct 1124 or produced in the second condensing duct 1124, from being introduced into the return duct 114.

The horizontal straight distance d1 between the upstream end 1124U and the downstream end 1124D of the second condensing duct 1124 can be longer than a horizontal straight distance d2 between the upstream end 1124U of the second condensing duct 1124 and the outlet port H2 (FIG. 6). For example, in the second direction, the downstream end 1124D of the second condensing duct 1124 can be located beyond a midpoint of the bottom 12B of the tub 12 (FIG. 6).

Therefore, even though the outlet port H2 is formed in the vicinity of the inlet port H1 in the horizontal direction to improve the drying performance, a horizontal length of the return duct 114 communicating with the outlet port H2 and the downstream end 1124D of the second condensing duct 1124 can increase, and a distance between and the downstream end 1124D of the second condensing duct 1124 and the upstream end 114U of the return duct 114 can increase. Therefore, a heater 350 having a sufficiently large size can be disposed inside or outside the return duct 114, and the fan 130 can be disposed between the downstream end 1124D of the second condensing duct 1124 and the upstream end 114U of the return duct 114. Therefore, the drying performance of the dishwasher 1 can be improved by the simple configuration, and the dishwasher 1 can have a compact structure having a small size.

As described above, the downstream end 1122D of the first condensing duct 1122 can be positioned in the vicinity of the lower end of the rear portion of one sidewall 12R of the tub 12, and the upstream end 1124U of the second condensing duct 1124 can be positioned in the vicinity of one side end of the rear portion of the bottom 12B of the tub 12 (FIGS. 3, 5, and 7). For example, the downstream end 1122D of the first condensing duct 1122 may be positioned adjacent to the rear lower portion R13 of one sidewall 12R of the tub 12 and the upstream end 1124U of the second condensing duct 1124 may be positioned adjacent to the one rear side portion B11 of bottom 12B of the tub 12. For example, the downstream end 1122D of the first condensing duct 1122 may be positioned closest to rear lower portion R13 among the nine regions R11 to R33 of one sidewall 12R of the tub 12 (FIG. 2 or 3), thereby being positioned in the vicinity of the lower end of the rear portion of one sidewall 12R. And the upstream end 1124U of the second condensing duct 1124 may be positioned closest to one rear side portion B11 among the nine regions B11 to B33 of bottom 12B of the tub 12 (FIG. 2 or 3), thereby being positioned in the vicinity of one side end of the rear portion of bottom 12B. Therefore, since both the downstream end 1122D of the first condensing duct 1122 and the upstream end 1124U of the second condensing duct 1124 are positioned at the rear side together with the inlet port H1 and the outlet port H2, the condensing duct 112 can be formed in a shape similar to a straight line, and the length of the condensing duct 112 can decrease. Therefore, the flow resistance can be reduced, and the drying performance can be improved.

The second condensing duct 1124 can have a second water drain port D2 (FIG. 17). Therefore, the water introduced through the inlet port H1 or the outlet port H2 or the water condensed in the condensing duct 112 can be discharged to the outside through the second water drain port D2, thereby improving the drying performance of the drying device 100.

In some examples, a second connection duct 1123 can be disposed between the first condensing duct 1122 and the second condensing duct 1124. The second connection duct 1123 can communicate with the downstream end 1122D of the first condensing duct 1122 and the upstream end 1124U of the second condensing duct 1124 (FIGS. 5 and 7).

As described above, the condensing duct 112 includes: the first condensing duct 1122 facing the outer surface of one sidewall 12R of the tub 12 and having the upstream end communicating with the inlet port H1; and the second condensing duct 1124 disposed lower than the bottom 12B of the tub 12 and having the upstream end communicating with the downstream end of the first condensing duct 1122. Therefore the condensing duct 112 adjoins the low-temperature air outside of one sidewall 12R of the tub 12 and lower than the bottom 12B of the tub 12 such that the moisture vapor contained in the air flowing along the condensing duct 112 is condensed into water and removed. Therefore, the drying performance can be improved by the simple structure and at low cost.

The upstream end 114U of the return duct 114 can communicate with the downstream end 1124D of the second condensing duct 1124, and a downstream end 114D of the return duct 114 can communicate with the outlet port H2.

For example, the downstream end 114D of the return duct 114 can communicate with the distributor 150 that is inserted into the washing space 12S through the outlet port H2 and discharges the air into the washing space 12S.

The second condensing duct 1124 and the return duct 114 can be positioned only under rear portions B11, B12, and B13 of the bottom 12B of the tub 12. Therefore, since the second condensing duct 1124 and the return duct 114 are positioned at the rear side together with the outlet port H2 and the inlet port H1, the second condensing duct 1124 and the return duct 114 can be formed in a shape similar to a straight line, and the lengths of the ducts 1124, and 114 can decrease. Therefore, the flow resistance can be reduced, and the drying performance can be improved. In some examples, the dishwasher 1 can have a compact structure having a small size.

The return duct 114 can be positioned between the bottom 12B of the tub 12 and the second condensing duct 1124. For example, at least a part of the return duct 114 can be disposed under the bottom 12B of the tub 12, and the part of the return duct 114 and the second condensing duct 1124 can be disposed vertically.

That is, at least a part of the return duct 114 can be disposed higher than the second condensing duct 1124.

Therefore, it can be possible to block (i) the water introduced into the second condensing duct 1124 through the inlet port H1 and (ii) the water condensed in the condensing duct 112 from being introduced into the return duct 114. Therefore, it can be possible to block the water in the condensing duct 112 from being introduced into the washing space 12S through the outlet port H2 communicating with the return duct 114, thereby improving the drying performance. That is, the drying performance can be improved by blocking the water from flowing reversely.

The return duct 114 and the second condensing duct 1124 can at least partially adjoin each other in the longitudinal direction of the return duct 114 and the second condensing duct 1124. At the portion where the return duct 114 and the second condensing duct 1124 adjoin each other, the return duct 114 and the second condensing duct 1124 can be separated by a separation wall W disposed in the longitudinal direction of the return duct 114 and the second condensing duct 1124 (FIGS. 16 to 19).

Therefore, the return duct 114 and the second condensing duct 1124 can be easily manufactured by the simple configuration and at low cost. In some examples, since the return duct 114 and the second condensing duct 1124 are separated by the single separation wall W, a part of heat generated from the heater 140 disposed in the return duct 114 can be easily transferred to the second condensing duct 1124. Therefore, a small amount of water in the second condensing duct 1124 is vaporized by the heat transferred to the second condensing duct 1124, and thus the humidity in the second condensing duct 1124 decreases, which makes it possible to reduce or prevent the proliferation of bacteria or mold in the second condensing duct 1124.

The return duct 114 can have a third water drain port D3 (FIG. 17). Therefore, the water introduced through the outlet port H2 and the water condensed in the return duct 114 can be discharged to the outside of the return duct 114 through the third water drain port D3, thereby improving the drying performance of the drying device 100. In this case, the outside of the return duct 114 can be the inside of the second condensing duct 1124 (FIG. 17).

The fan 130 can be disposed between the downstream end 1124D of the condensing duct 112 and the downstream end 114D of the return duct 114. For example, the fan 130 can be disposed between the second condensing duct 1124 and the return duct 114.

Therefore, the fan 130 can help to prevent the occurrence of vortex and allow the air to smoothly flow in a downstream portion (e.g., between the condensing duct and the return duct) of the drying duct 110 where the flow direction of the air is considerably changed. Therefore, flow resistance is not increased, which makes it possible to improve the drying performance of the drying device 100.

The fan 130 can communicate with the second condensing duct 1124 (FIG. 19). For example, the fan 130 can communicate downwardly with the downstream end 1124D of the second condensing duct 1124.

In some examples, the fan 130 can communicate with the return duct 114 (FIG. 19). For example, the fan 130 can communicate laterally with the upstream end 114U of the return duct 114.

In some examples, the fan 130 can be disposed higher than the downstream end 1124D of the second condensing duct 1124 (FIG. 19). Therefore, a motor 136 of the fan 130 may not come into contact with the water introduced into the condensing duct 112 or the water condensed in the condensing duct 112. Therefore, the water may not be introduced into the motor 136 of the fan 130, which can help to prevent the fan 130 from being broken down, thereby improving the durability and stability of the drying device 100.

The fan 130 can allow the air to flow in the drying duct 110. Specifically, for example, the fan 130 can introduce the air in the first condensing duct 1122 into the second condensing duct 1124. In some examples, the fan 130 can introduce the air in the second condensing duct 1124 into the return duct 114. In some examples, the fan 130 can discharge the air in the return duct 114 into the washing space 12S through the outlet port H2 and the distributor 150 to be described below.

The fan 130 can include a fan blade 132, a fan housing 134, and the motor 136.

The fan blade 132 can be fixedly coupled to a rotary shaft 138 and rotated by the motor 136. The fan blade 132 can be accommodated in the fan housing 134.

The fan housing 134 can communicate with the downstream end 1124D of the second condensing duct 1124 and the upstream end 114U of the return duct 114.

For example, the fan housing 134 can have a through-hole formed in a lower surface thereof and communicate downwardly with the downstream end 1124D of the second condensing duct 1124 (FIG. 19). In some examples, the fan housing 134 can have a through-hole formed in a lateral surface thereof and communicate laterally with the upstream end 114U of the return duct 114 (FIG. 19).

The fan housing 134 can include an upper wall 134T. The upper wall 134T can be disposed between the fan blade 132 and the motor 136 disposed above the fan blade 132.

Therefore, even though the fan blade 132 comes into contact with the water introduced into the return duct 114 through the outlet port H2, the water being in contact with the fan blade 132 is blocked by the upper wall 134T, such that the water cannot come into contact with the motor 136. Therefore, the water may not be introduced into the motor 136, which can help to prevent the fan 130 from being broken down, thereby improving the durability and stability of the drying device 100.

The upper wall 134T can have a hole penetrated by the rotary shaft 138.

The motor 136 can be coupled to the fan blade 132 by means of the rotary shaft 138. The motor 136 can rotate the fan blade 132.

The motor 136 can be disposed above the fan blade 132. In some examples, the motor 136 can be disposed on the upper wall 134T.

The rotary shaft 138 of the fan 130 can extend in an approximately vertical direction.

Therefore, the fan 130 can be installed to be laid between the second condensing duct 1124 and the return duct 114. Therefore, the fan 130 having a sufficiently large size can be installed even though the installation space or the installation position is restricted. Therefore, the drying performance of the dishwasher 1 can be improved by the simple configuration and at low cost, and the dishwasher 1 can have a compact structure having a small size. In this case, the fan 130 can be a centrifugal fan. In some examples, since the motor 136 can be disposed above the fan blade 132, it can be possible to help to prevent the water from being introduced into the motor 136.

The heater 140 can be disposed between the downstream end 1124D of the condensing duct 112 and the downstream end 114D of the return duct 114. For example, the heater 140 can be disposed in the return duct 114.

Therefore, the heater 140 can heat the air in the downstream portion (e.g., the return duct) of the drying duct 110 close to the outlet port H2 and discharge the high-temperature dry air into the washing space 12S, thereby improving the drying performance by the simple configuration and at low cost.

The heater 140 can be disposed in the return duct 114 (FIGS. 14 to 19). However, the present disclosure is not limited to this configuration. For example, unlike the drawings, the heater 140 can be provided adjacent to the return duct 114 and disposed outside the return duct 114.

Since the heater 140 is disposed in the return duct 114 as described above, the air can be effectively heated in the return duct 114 close to the outlet port H2. Therefore, the heated air flowing into the washing space 12S can effectively remove moisture remaining on dishes in the washing space 12S. Therefore, the drying performance can be improved by the simple structure and at low cost.

In some examples, since the heater 140 is disposed in the return duct 114, the heater 140 is positioned to be distant from the water introduced into the condensing duct 112 or the water condensed in the condensing duct 112 without coming into contact with the water. Therefore, it can be possible to reduce or prevent the heat generated by the heater 140 from vaporizing a large amount of water collected in the condensing duct 112. Therefore, the high-temperature dry air in the return duct 114 can flow into the washing space 12S, thereby improving the drying performance.

In some implementations, the heater 140 can heat the air in the drying duct 110.

As described above, the drying device 100 includes the drying duct 110, the fan 130, and the heater 140, and the drying duct 110 is disposed outside the tub 12 and includes the condensing duct 112 and the return duct 114, which makes it possible to improve the drying performance by the simple configuration and at low cost.

In some implementations, as illustrated in FIG. 18, the distributor 150 can include an insertion part 152 and a lid 154.

A lower end of the insertion part 152 can communicate with the downstream end 114D of the return duct 114, and an upper end of the insertion part 152 can be coupled to the lid 154. The insertion part 152 can be installed to penetrate the outlet port H2 formed in the bottom 12B of the tub 12.

The air heated in the return duct 114 can flow into the washing space 12S through the insertion part 152.

The lid 154 can be installed at an upper end of the insertion part 152 and disposed in the washing space 12S. In some examples, the lid 154 can help to prevent the water in the washing space 12S from being introduced into the insertion part 152 and the return duct 114.

For example, the lid 154 can help to prevent the air flowing out of the insertion part 152 from flowing upward in the vertical direction when the air is introduced into the washing space 12S. Therefore, since the condition i) is satisfied, the dry air introduced into the washing space 12S through the outlet port H2 can effectively circulate everywhere in the washing space 12S until the dry air is introduced into the drying device 100 through the inlet port H1, thereby improving the drying efficiency.

In some examples, the downstream duct portion 1124B, the fan housing 134, and the return duct 114 illustrated in FIGS. 15 to 17 can include a first housing C1, a second housing C2, a third housing C3, and a fourth housing C4, as illustrated in FIG. 18.

The first housing C1 can be disposed at the lower side and opened upward.

The second housing C2 can be disposed on the first housing C1 and coupled to the first housing C1.

The third housing C3 can be opened downward, disposed on the second housing C2, and coupled to the second housing C2.

The fourth housing C4 can be disposed one end of the second housing C2 and coupled to the second housing C2.

The downstream duct portion 1124B can be defined by the first housing C1 and the second housing C2, and the return duct 114 can be defined by the second housing C2 and the third housing C3. The separation wall W can be the bottom of the second housing C2.

The fan housing 134 can be defined by one end of the second housing C2 and the fourth housing C4. That is, a part of the fan housing 134 (one end of the second housing) can be integrated with a part of the return duct 114 (the remaining part of the second housing). The fourth housing C4 can be the upper wall 134T of the fan housing 134.

The second water drain port D2 can be formed in the bottom of the first housing C1, and the third water drain port D3 can be formed in the bottom of the second housing C2.

The heater 140 can be disposed in the internal space defined by coupling the second housing C2 and the third housing C3. In this case, a fixing part 142, which has high heat resistance and low thermal conductivity, can be fixed to the second housing C2 or the third housing C3, and the heater 140 can be installed by being coupled to the fixing part 142. Therefore, it can be possible to help to prevent the second housing C2 or the third housing C3 from being damaged by the heater 140.

As described above, the downstream duct portion 1124B, the fan housing 134, and the return duct 114 can be configured by coupling the first housing C1, the second housing C2, the third housing C3, and the fourth housing C4. Therefore, the drying device 100 can be simply and easily manufactured and easily maintained. Further, the drying device 100 can have a compact structure having a small size.

In some examples, for convenience, the configuration has been described in which the drying duct 110 is divided into the condensing duct 112 and the return duct 114. However, the condensing duct 112 and the return duct 114 can be integrated. In some examples, the first condensing duct 1122 and the second condensing duct 1124 can also be integrated.

In some implementations, the ducts 110, 112, 1122, 1124, and 114 can each be made of a metallic material such as aluminum or stainless steel. In some examples, the ducts 110, 112, 1122, 1124, and 114 can be manufactured by steel metal working or injection molding.

In some implementations, some components of the drying device 100, such as the fan 130, can be made of plastic.

While the present disclosure has been described above with reference to the accompanying drawings, the present disclosure is not limited to the drawings and the implementations disclosed in the present specification, and it is apparent that the present disclosure can be variously changed by those skilled in the art without departing from the technical spirit of the present disclosure. Further, even though the operational effects of the configurations of the present disclosure have not been explicitly disclosed and described in the description of the implementation of the present disclosure, the effects, which can be expected by the corresponding configurations, should be acceptable.

What is claimed is:

1. A dishwasher comprising:

a tub having a washing space defined therein;

a door disposed at a front side of the tub and configured to open and close at least a portion of the washing space; and a drying device configured to supply air to the washing space, the drying device comprising:

a first condensing duct that is disposed outside the tub and faces an outer surface of the tub, the first condensing duct being in fluid communication with an inlet port defined at the tub and extending in a vertical direction and a first direction that intersects the vertical direction, a fan configured to cause a flow of air in the first condensing duct, a second condensing duct that is in fluid communication with the first condensing duct and disposed lower than a bottom of the tub, the second condensing duct having a water drain port defined at a bottom of the second condensing duct, a return duct that is in fluid communication with the second condensing duct and disposed between the bottom of the tub and the second condensing duct, at least a part of the return duct being disposed higher than the second condensing duct, wherein the return duct has a water drain port that is defined at a bottom of the return duct and in fluid communication with an inside of the second condensing duct.

2. The dishwasher of claim 1, wherein the first condensing duct comprises:

an upstream portion that is in fluid communication with the inlet port;

a downstream portion that is in fluid communication with the upstream portion and includes a bent portion disposed below the upstream portion, the downstream portion extending from the upstream portion downward to the bent portion and then extending upward from the bent portion; and a rib that is disposed inside the bent portion and extends across the bent portion, the rib protruding in a second direction that intersects the vertical direction and the first direction, wherein the first condensing duct further comprises a first water drain port that is disposed at a lower end of the bent portion, and wherein the water drain port of the second condensing duct is a second water drain port, and the water drain port of the return duct is a third water drain port.

3. The dishwasher of claim 2, further comprising:

a heat exchange portion that is connected to the upstream portion and extends downward from the upstream portion to the downstream portion, the downstream portion being in communication with a downstream end of the heat exchange portion.

4. The dishwasher of claim 3, wherein the heat exchange portion has a first surface and a second surface that face each other in the first direction, wherein the bent portion extends toward a first side of the first direction, and wherein the first water drain port and the lower end of the bent portion are disposed at a position closer to the first surface of the heat exchange portion than the second surface of the heat exchange portion in the first direction.

5. The dishwasher of claim 2, wherein the downstream portion has lateral surfaces that face each other and define the bent portion therebetween, and wherein the rib protrudes inward from the lateral surfaces of the bent portion in the second direction.

6. The dishwasher of claim 2, wherein the rib traverses the bent portion in an up-down direction.

7. The dishwasher of claim 6, wherein the rib is connected to at least one of a lower surface of the bent portion or an upper surface of the bent portion.

8. The dishwasher of claim 7, wherein an upper end of the rib extends in the second direction and is connected to the upper surface of the bent portion.

9. The dishwasher of claim 6, wherein a lower end of the rib is positioned adjacent to the first water drain port.

10. The dishwasher of claim 6, wherein the bent portion extends toward a first side of the first direction, and wherein the rib has a lower end and an upper end, the upper end being disposed above the lower end and offset from the lower end toward the first side of the first direction.

11. The dishwasher of claim 6, wherein the rib comprises a height section in which a gradient of the rib increases as the rib extends upward.

12. The dishwasher of claim 6, wherein the bent portion comprises:

a descending duct portion having an upstream end that is in fluid communication with the upstream portion, the descending duct portion extending downward in a descending inclined direction with respect to the vertical direction and toward a first side of the first direction; and an ascending duct portion that is in fluid communication with a downstream side of the descending duct portion, the ascending duct portion extending upward in an ascending inclined direction with respect to the vertical direction and toward the first side of the first direction, and wherein an upper end of the rib is positioned in the ascending duct portion.

13. The dishwasher of claim 2, wherein the rib is one of a plurality of ribs that extend in parallel to one another and that are disposed inside the bent portion.

14. The dishwasher of claim 13, wherein at least one of the plurality of ribs extends to a position adjacent to the first water drain port.

15. The dishwasher of claim 14, wherein the plurality of ribs comprise:

a first portion disposed at a first side with respect to the first water drain port in the first direction, and a second portion disposed at a second side with respect to the first water drain port, the second side being opposite to the first side with respect to the first water drain port.

16. The dishwasher of claim 15, wherein a curve length of the first portion of the plurality of ribs is less than a curve length of the second portion of the plurality of ribs.

17. The dishwasher of claim 15, wherein the first portion of the plurality of ribs is connected to the lower end of the bent portion, and the second portion of the plurality of ribs is connected to an upper end of the bent portion.

18. The dishwasher of claim 14, wherein a distance in the first direction between the lower end of the bent portion and the inlet port is greater than a distance in the first direction between an upper end of the bent portion and the inlet port.

19. The dishwasher of claim 2, wherein a downstream end of the upstream portion and an upstream end of the downstream portion are disposed at one side of the inlet port in the first direction and spaced apart from each other in the vertical direction.

20. The dishwasher of claim 19, further comprising:

a heat exchange guide that is disposed between the downstream end of the upstream portion and the upstream end of the downstream portion, the heat exchange guide extending in the first direction.

* * * * *